US011800957B2

(12) United States Patent
Sisto

(10) Patent No.: US 11,800,957 B2
(45) Date of Patent: Oct. 31, 2023

(54) AMENITY FLUID DISPENSING SYSTEM

(71) Applicant: Salto, LLC, Philadelphia, PA (US)

(72) Inventor: Salvatore Sisto, East Brunswick, NJ (US)

(73) Assignee: Salto, LLC

( * ) Notice: Subject to any disclaimer, the term of this patent is extended or adjusted under 35 U.S.C. 154(b) by 0 days.

(21) Appl. No.: 17/689,258

(22) Filed: Mar. 8, 2022

(65) Prior Publication Data

US 2022/0287514 A1 Sep. 15, 2022

Related U.S. Application Data

(60) Provisional application No. 63/160,267, filed on Mar. 12, 2021.

(51) Int. Cl.
*A47K 5/12* (2006.01)

(52) U.S. Cl.
CPC ..... *A47K 5/1211* (2013.01)

(58) Field of Classification Search
CPC . B05B 9/0816; B05B 9/0822; B05B 11/0054; B67D 1/0425; B67D 3/0029; B67D 1/0078; A47K 5/1204; A47K 5/1211; B65D 2583/005
USPC ..... 222/401, 325, 181.1
See application file for complete search history.

(56) References Cited

U.S. PATENT DOCUMENTS 2,529,365 A * 11/1950 Barksdale ..... A47K 5/1211 222/400.5
2,772,817 A 12/1956 Jauch
3,200,994 A 8/1965 Levinson et al.
3,685,694 A 8/1972 Ianelli
4,173,858 A 11/1979 Cassia
4,310,104 A * 1/1982 Takatsuki ..... B67D 1/0425 222/401
4,345,627 A 8/1982 Cassia
5,086,950 A 2/1992 Crossdale
5,183,182 A 2/1993 Comstock et al.
5,791,525 A 8/1998 Fan
5,842,609 A 12/1998 Higgins et al.
6,082,593 A 7/2000 Borcherds
6,142,750 A 11/2000 Benecke
6,619,509 B2 9/2003 DeKoning
7,837,132 B2 11/2010 Mazooji et al.
(Continued)

*Primary Examiner* — Vishal Pancholi
*Assistant Examiner* — Robert K Nichols, II
(74) *Attorney, Agent, or Firm* — BELLES KATZ LLC

(57) ABSTRACT

An air-assisted, gravity feed amenity fluid dispensing system suitable for use with personal care fluids. The system may be embodied in a fluid dispenser including a support structure attachable to a support surface such as a wall and an openable canister supported by the support structure. The canister defines an internal cavity configured for inserting a recyclable container pre-packaged with the personal care fluid, and a fluid dispensing mechanism including an air pump configured to pressurize and dispense the fluid from the container through a dispensing hole in the canister. The air pump may be manually-operated in one embodiment to pump air into the container and dispense fluid each time a user depresses an actuator button. The personal care fluid may alternatively be filled directly into the canister without use of an insertable fluid container. Plural canisters each containing different fluids may be supported by the support structure.

24 Claims, 39 Drawing Sheets

(56) References Cited

U.S. PATENT DOCUMENTS

| | | | |
|---|---|---|---|
| 7,857,170 | B2 | 12/2010 | Ophardt |
| 8,662,355 | B2 | 3/2014 | Spiegelberg et al. |
| 9,033,193 | B2 | 5/2015 | Dong et al. |
| 9,307,871 | B2 | 4/2016 | McNulty et al. |
| 9,504,360 | B2 | 11/2016 | Liu |
| D784,726 | S | 4/2017 | Boyd |
| D795,608 | S | 8/2017 | Boyd |
| 9,949,599 | B2 | 4/2018 | Harris |
| 2013/0299518 | A1 | 11/2013 | McNulty et al. |
| 2020/0197966 | A1 | 6/2020 | Marshall et al. |

* cited by examiner

AMENITY FLUID DISPENSING SYSTEM

CROSS-REFERENCE TO RELATED APPLICATIONS

The present application claims benefit of priority to U.S. Provisional Application No. 63/160,267 filed Mar. 12, 2021, which is incorporated herein by reference in its entirety.

BACKGROUND

The present invention generally relates to fluid dispensing systems, and more particularly to such a system for dispensing personal care fluids.

Surface-mounted fluid dispensers are available for dispensing a variety of personal care fluids. Such fluids may include liquid soap or body wash, shampoo, conditioner, and various types of lotions including moisturizers. A commonality of such dispensers is the use of a manually-actuated fluid pump which directly pumps and dispenses the fluid from a reservoir to the user. Actuating these type fluid pumps draws or pulls the fluid directly from the reservoir into and through the moving pumping mechanism. This causes the moving parts and/or valves of such vacuum pumping mechanisms to often become clogged or blocked over time by dried solid or gelatinous accumulations or deposits of the fluids, which are often relatively viscous in the first place. This adversely impedes the proper operation and reliability of the fluid pumps resulting in various operational difficulties such as sticking, reduced flow, or others.

An improved fluid dispensing system for personal care fluids is desired.

SUMMARY

The present disclosure provides an air-assisted/gravity-feed amenity fluid dispensing system suitable for use with personal care fluids which overcomes the drawbacks of the foregoing fluid type pumps. In one embodiment, the fluid dispensing system comprises a fluid dispenser having a fluid dispensing mechanism including a manually-actuated air pump for dispensing fluids in lieu of a fluid pump described above. The air pump is configured and operable to pump air directly into a fluid reservoir. The air pump pressurizes the reservoir to force and dispense the fluid outwards through a mechanically simple outlet, such as a dispensing tube having no moving parts in one embodiment. Gravity assists with dispensing the fluid in a generally vertical and downward direction in conjunction with pressurized air which displaces the fluid. This present fluid dispensing system contrasts to the manually actuated fluid pumps of the past which draw or pull the fluid directly through the fluid pump mechanism from the reservoir leading to dispensing problems over time. The air pump advantageously thus remains clean and does not require replacement or cleaning since the fluid does not contact the air pump mechanism and components thereof. Only air is pumped through the air pump.

In one embodiment, the reservoir may be internally formed and defined by replaceable/recyclable personal care fluid containers detachably mounted and insertable into an outer housing such as a cylindrical canister in one embodiment which is supported by a surface-mountable support structure, as further described herein. In other embodiments, the fluid may be refilled from a bulk fluid supply and the fluid container may be a permanent part of the fluid dispenser assembly, or eliminated entirely in which case the fluid is simply filled directly into the canister without an inner container. As opposed to directly filling the fluid into the canister, the containers offer a sanitary option by advantageously eliminating the need for periodically cleaning out the interior of the canister. The containers may be swapped out rapidly when empty, which is particularly beneficial in hospitality industry settings such as hotels where quick cleaning and turnaround of rooms between guests is important. The air pumping mechanism would function in the same manner regardless of whether or not a replaceable fluid container is used with the canister.

The support structure may be a shelf unit in one implementation. A plurality of canisters may be supported from a single shelf unit or other support structure. Each canister may contain a different amenity or personal care fluid such as shampoo, conditioner, body wash, etc. The present fluid dispenser may be used in a bathroom (e.g., bath sink or shower setting) in some applications.

In some embodiments, the fluid dispenser may be configured to removably house and enclose a plurality of personal care fluid containers each fluidly coupled to a dedicated air pump dispensing mechanism. The dispenser may be configured for surface mounting such as via fasteners. The individual housings which hold the containers may comprise a fixed portion and a removable portion to access and exchange empty containers. In some embodiments, the containers which define reservoirs for personal care fluids may comprise a frangible seal which is automatically pierced or punctured by specially configured puncturing elements comprising an air tube and fluid dispensing tube. This fluidly couples each of the air pumps to its respective fluid container and also fluidly couples each container to its respective fluid dispensing tube, as further described herein.

In one aspect, a fluid dispenser for personal care fluids comprises: a support structure attachable to a support surface; a canister supported by the support structure, the canister defining a vertical centerline, a dispensing hole, and an internal cavity configured for inserting a fluid container containing a personal care fluid; the canister comprising a fluid dispensing mechanism configured to pressurize and dispense the fluid from the fluid container through the dispensing hole. The fluid dispensing mechanism may comprise a button actuated air pump operable to pump air into the fluid container which pressurizes the fluid. In one embodiment, the air pump is manually operated; the button being moveable between an outward actuated position and an inward unactuated position.

In another aspect, a method for dispensing a personal care fluid comprises: providing a surface-mountable fluid dispenser housing a reservoir holding the fluid; manually actuating an air pump; pumping air into the reservoir; and dispensing fluid from the reservoir which is displaced by the air pumped into the container. In one embodiment, the manually actuating step comprises pushing a spring-biased actuator button of an air pump fluidly coupled to the reservoir.

BRIEF DESCRIPTION OF THE DRAWINGS

The features of the preferred embodiments will be described with reference to the following drawings where like elements are labeled similarly, and in which.

Figure 1:
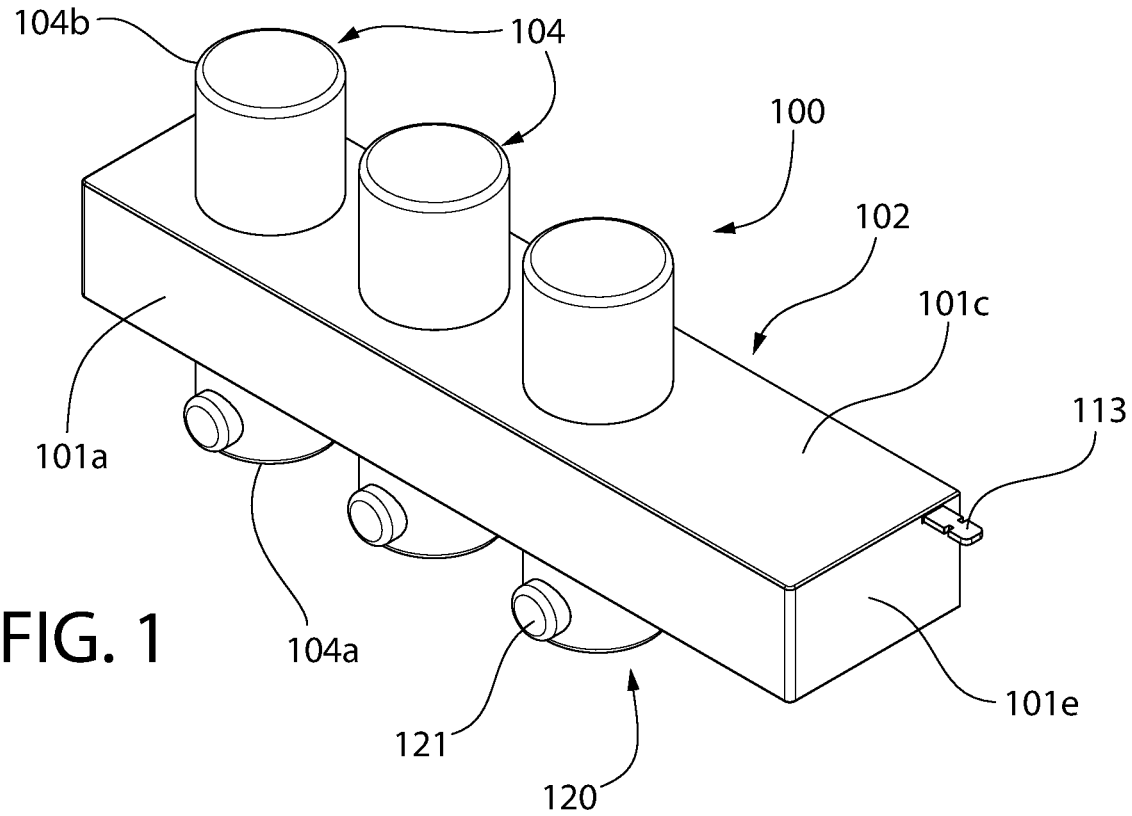
FIG. 1 is a first top perspective view of a one embodiment of an air-assisted/gravity-feed manually-operated fluid dispensing system according to the present disclosure which comprises a plurality of fluid dispensing canisters supported by a shelf unit.
Figure 2:
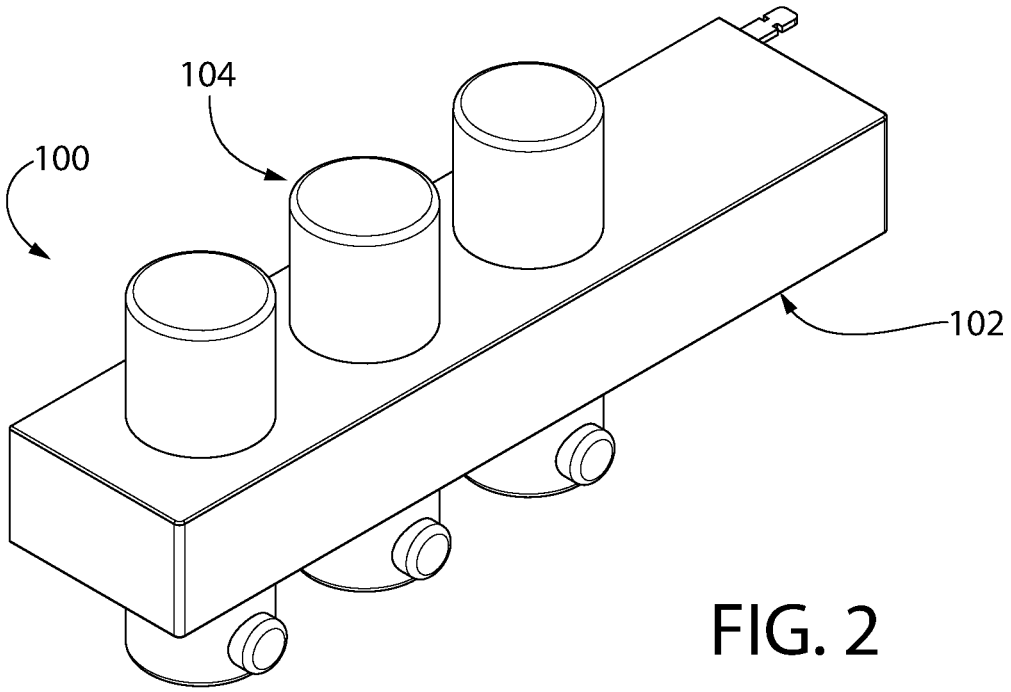
FIG. 2 is a second top perspective view thereof.
Figure 3:
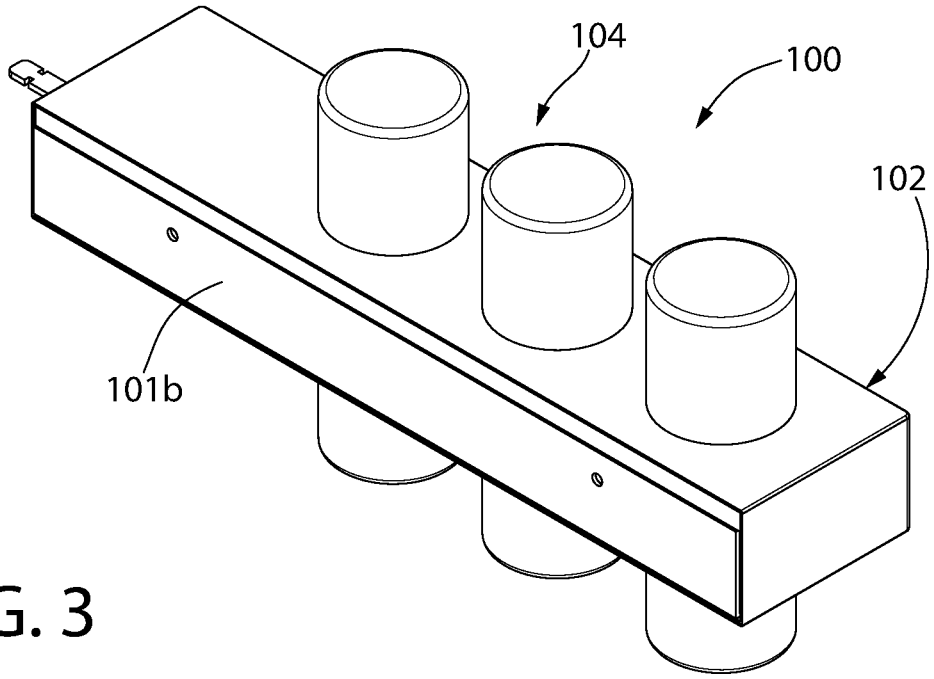
FIG. 3 is a third top perspective view thereof.
Figure 4:
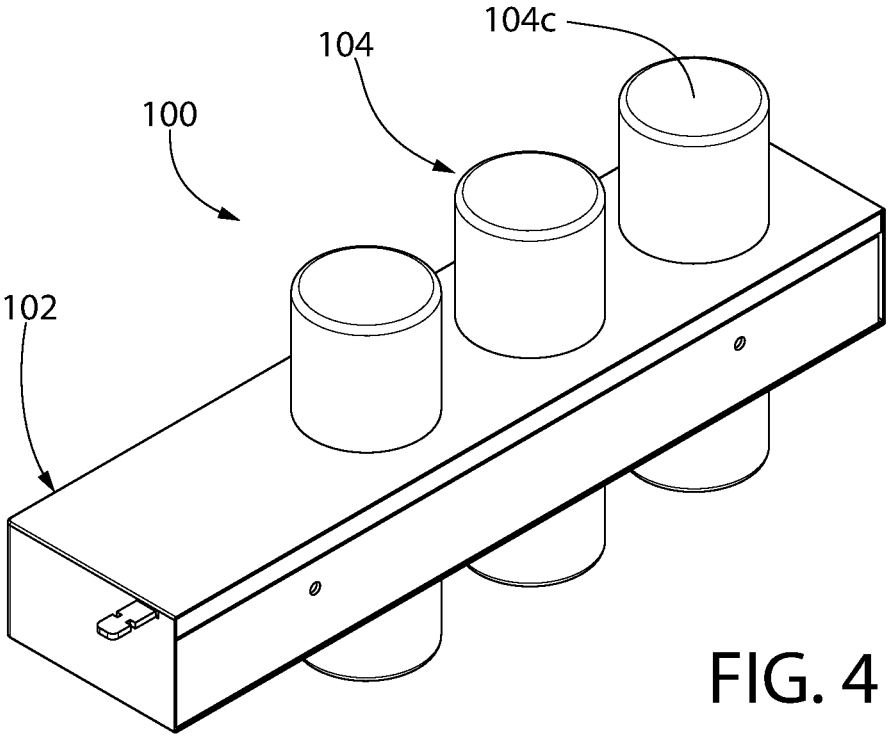
FIG. 4 is a fourth top perspective view thereof.
Figure 5:
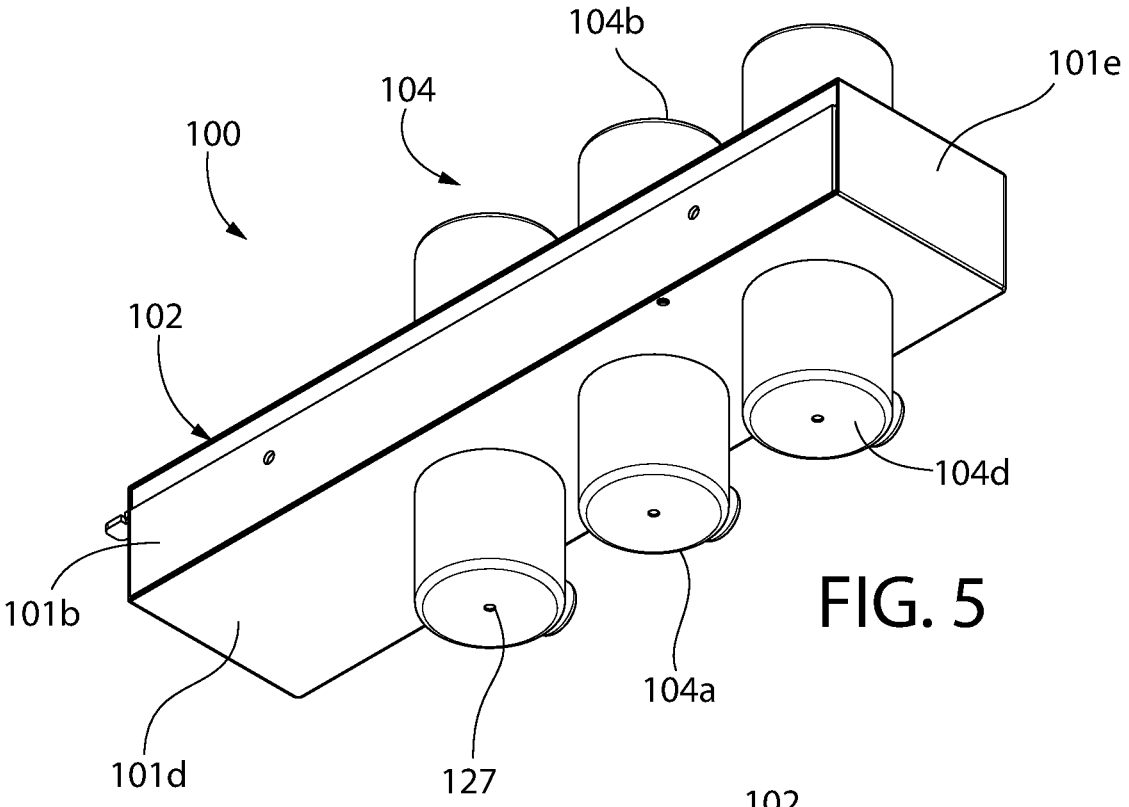
FIG. 5 is a first bottom perspective view thereof.
Figure 6:
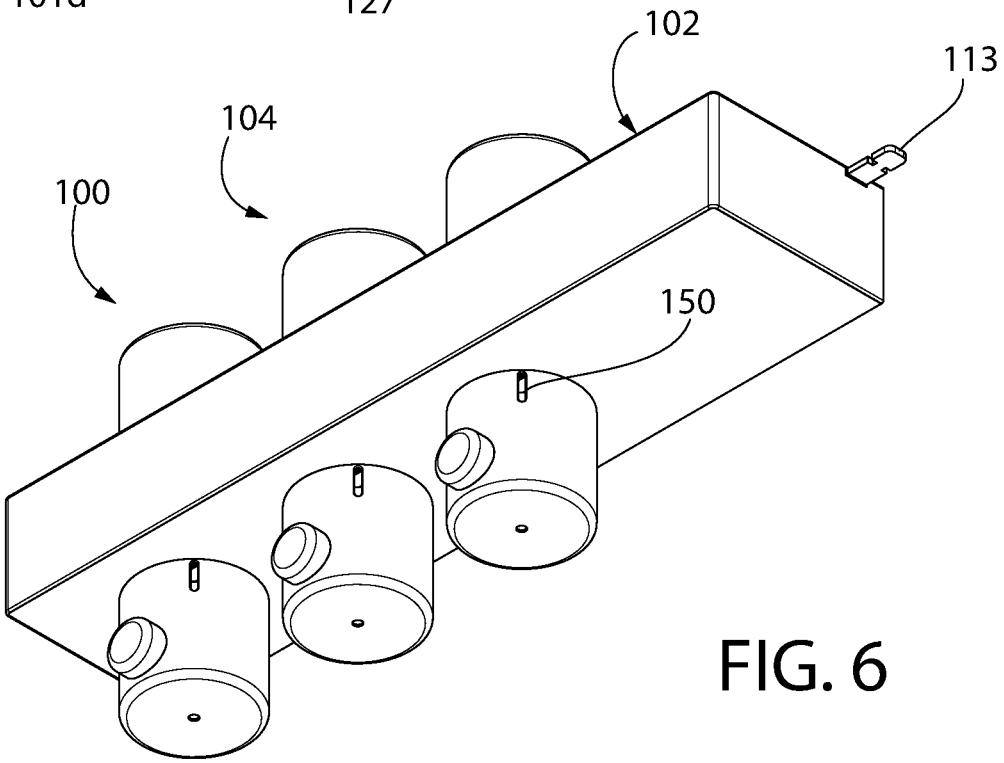
FIG. 6 is a second bottom perspective view thereof.
Figure 7:
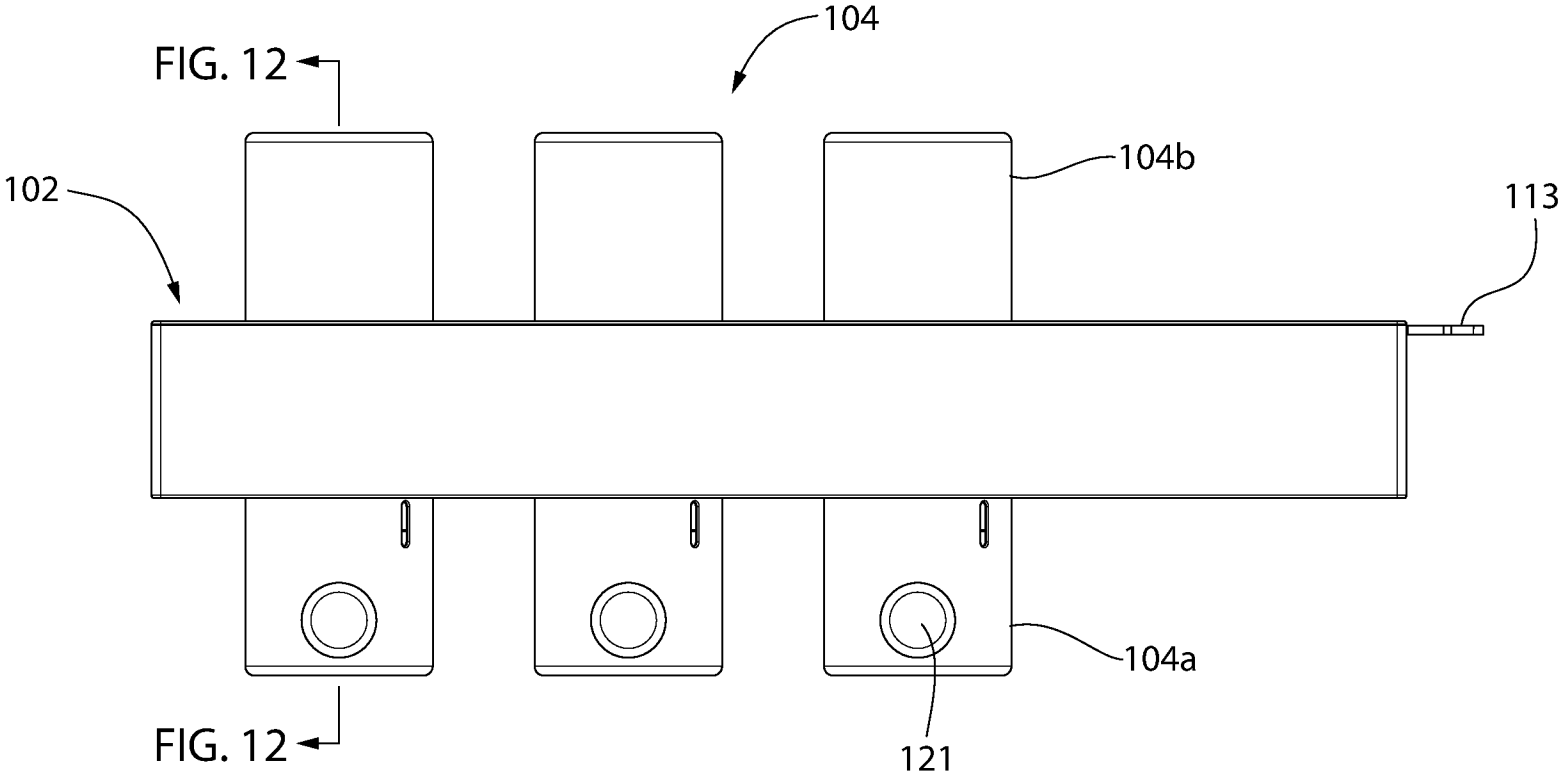
FIG. 7 is a front view thereof.
Figure 8:
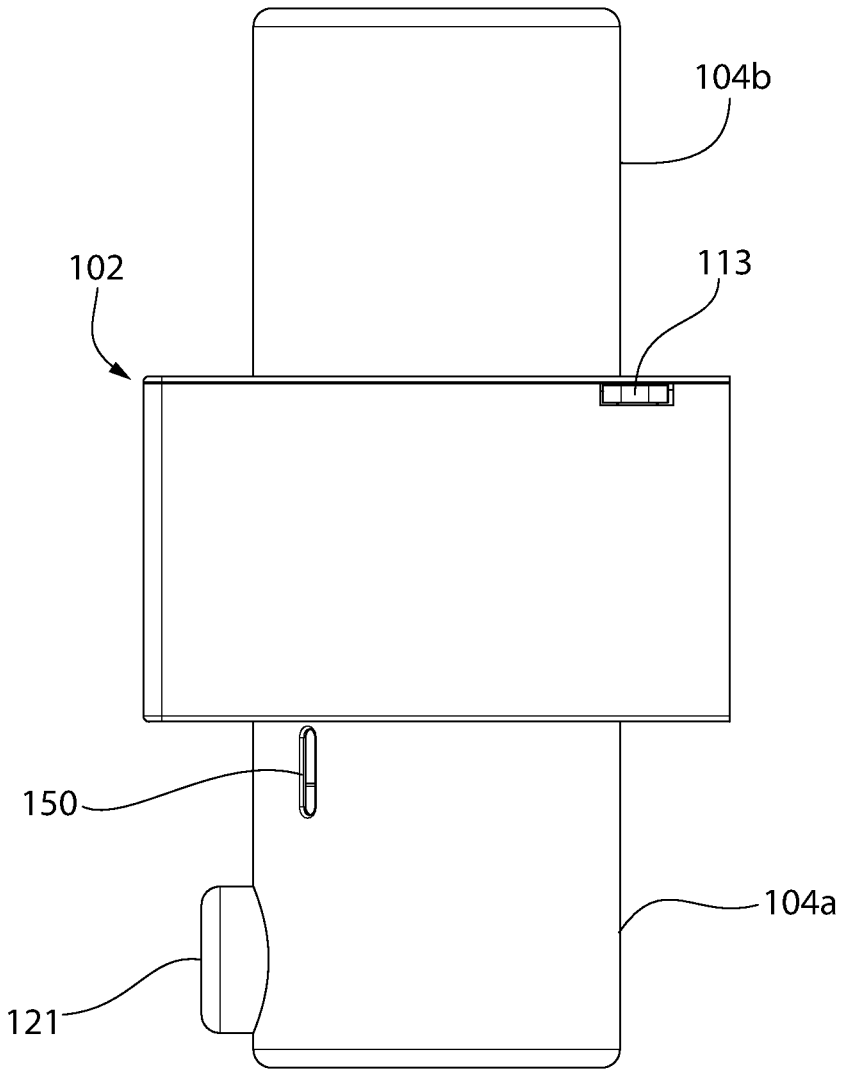
FIG. 8 is a side view thereof.
Figure 9:
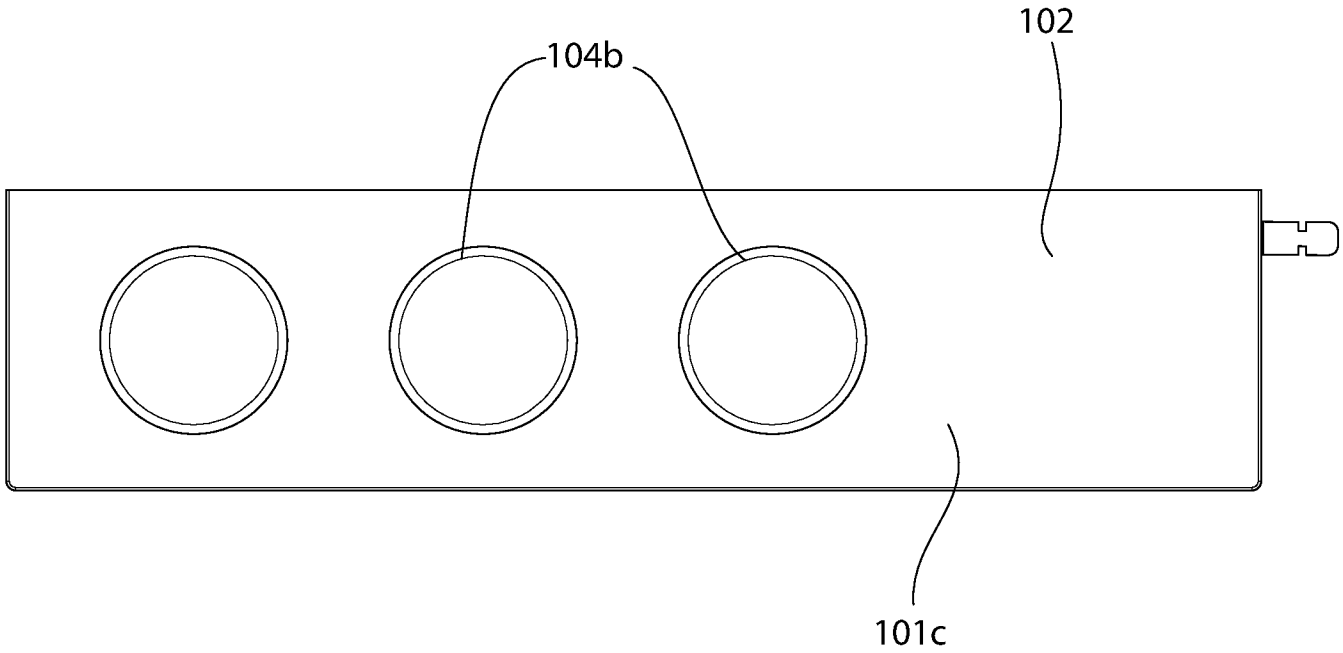
FIG. 9 is a bottom view thereof.
Figure 10:
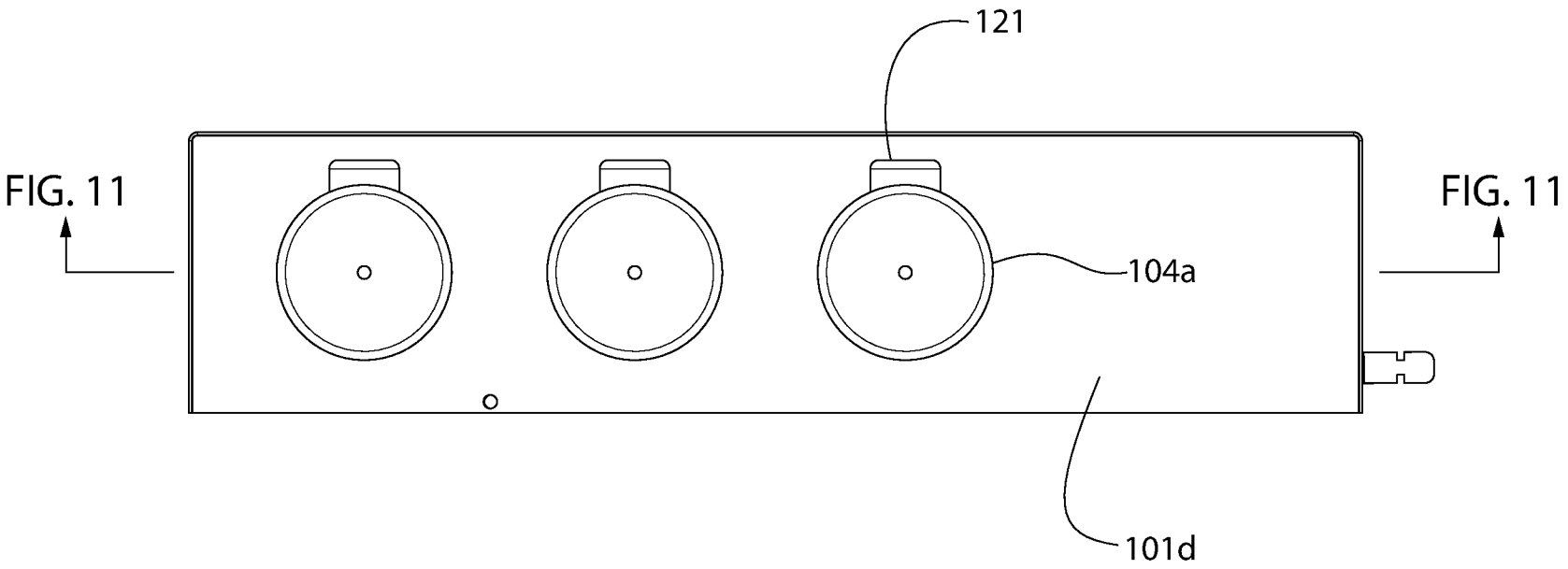
FIG. 10 is a top view thereof.
Figure 11:
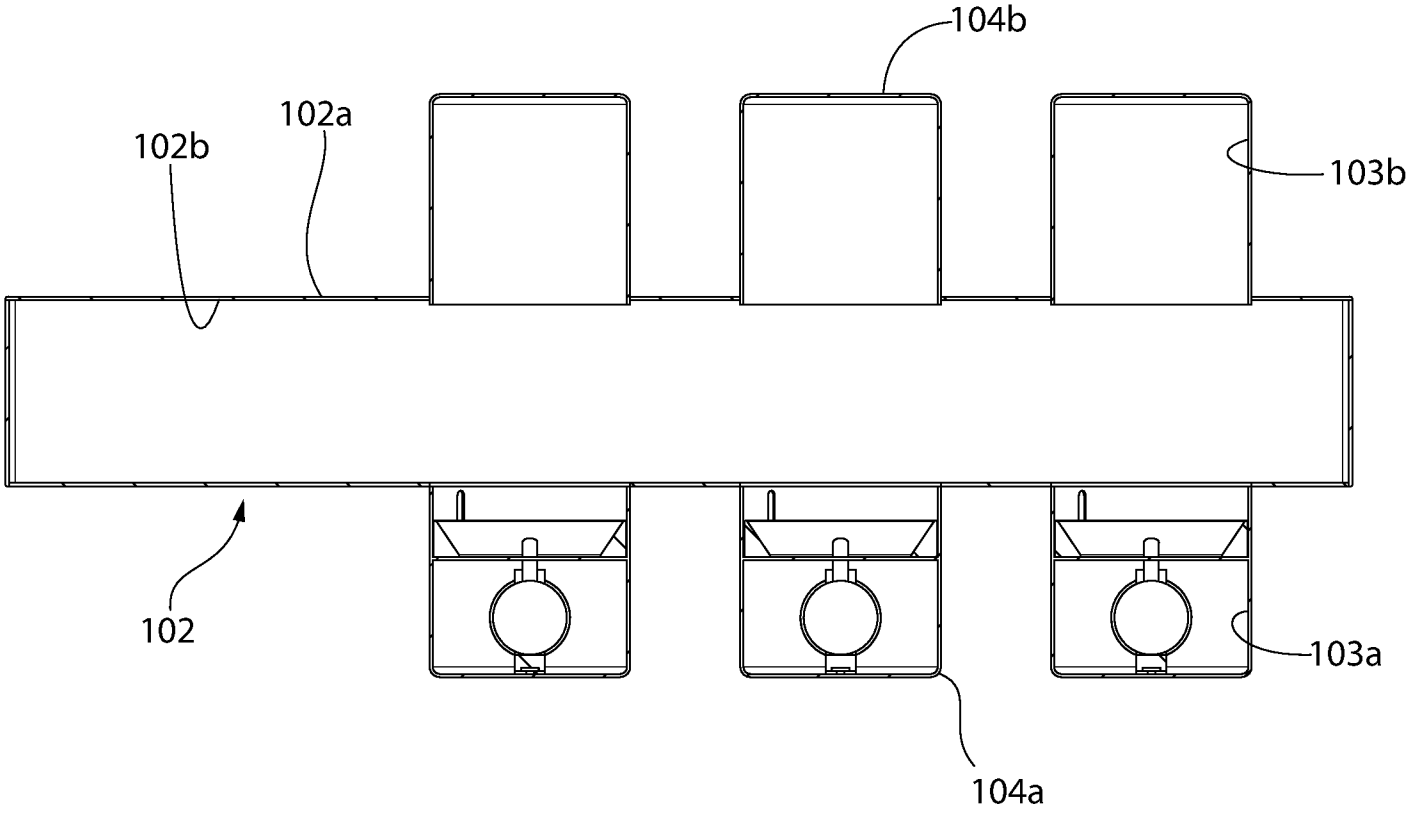
FIG. 11 is a longitudinal transverse cross sectional view thereof taken from FIG. 10.
Figure 12:
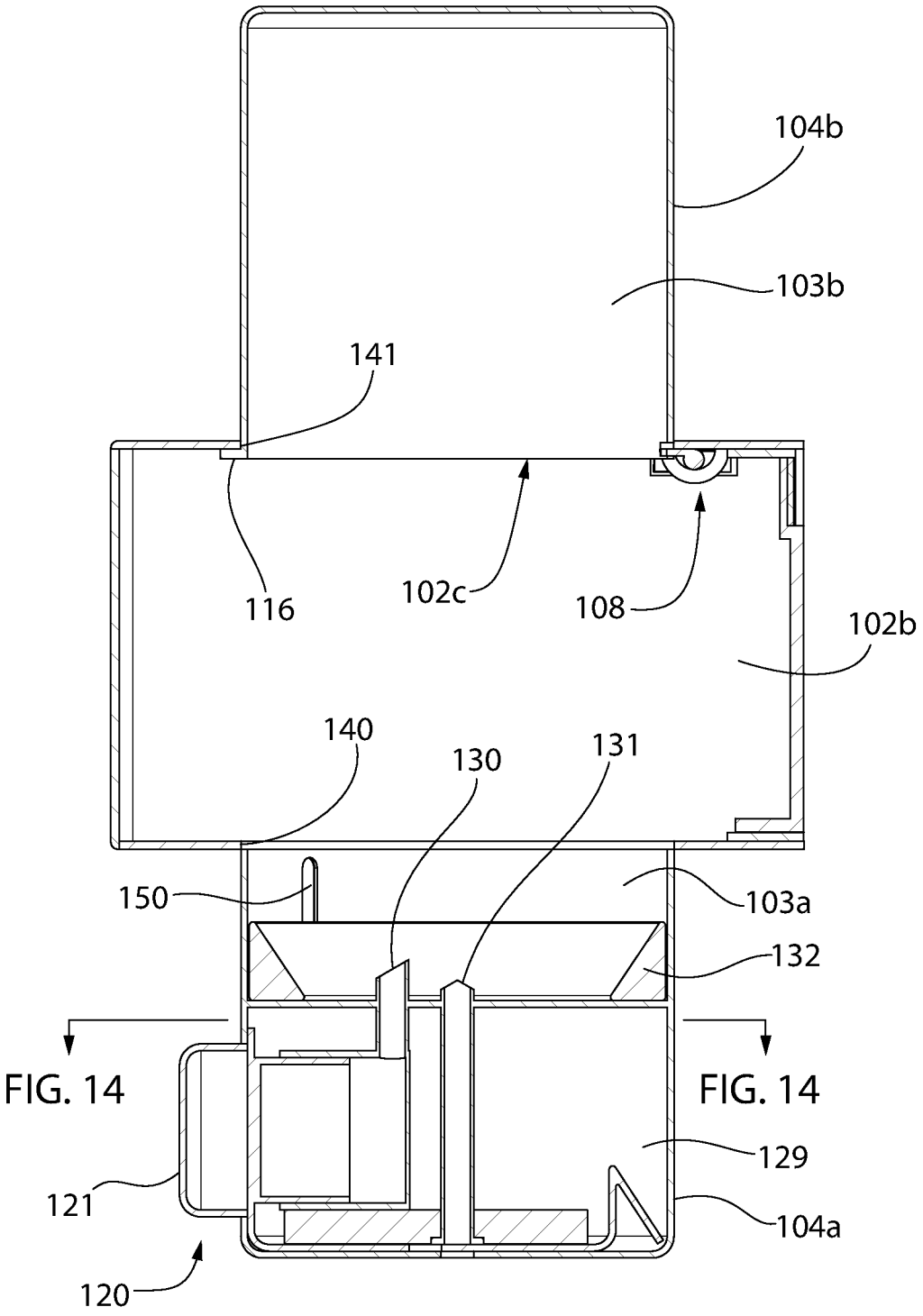
FIG. 12 is a first side transverse cross sectional view of one canister of the fluid dispensing system showing the upper canister section in a closed position.
Figure 13:
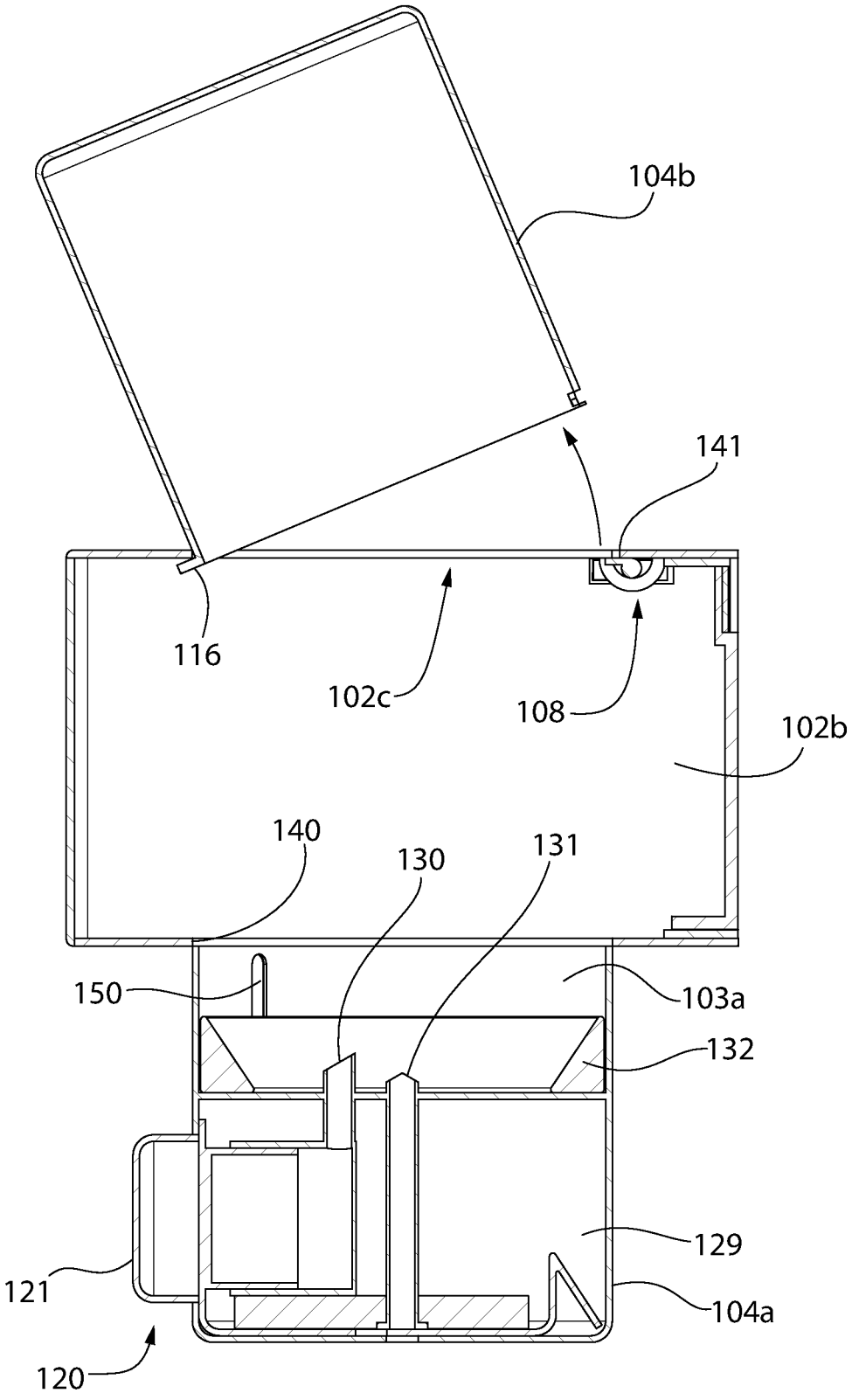
FIG. 13 is a second side transverse cross sectional view of one canister of the fluid dispensing system showing the upper canister section in a partially open position.
Figure 14:
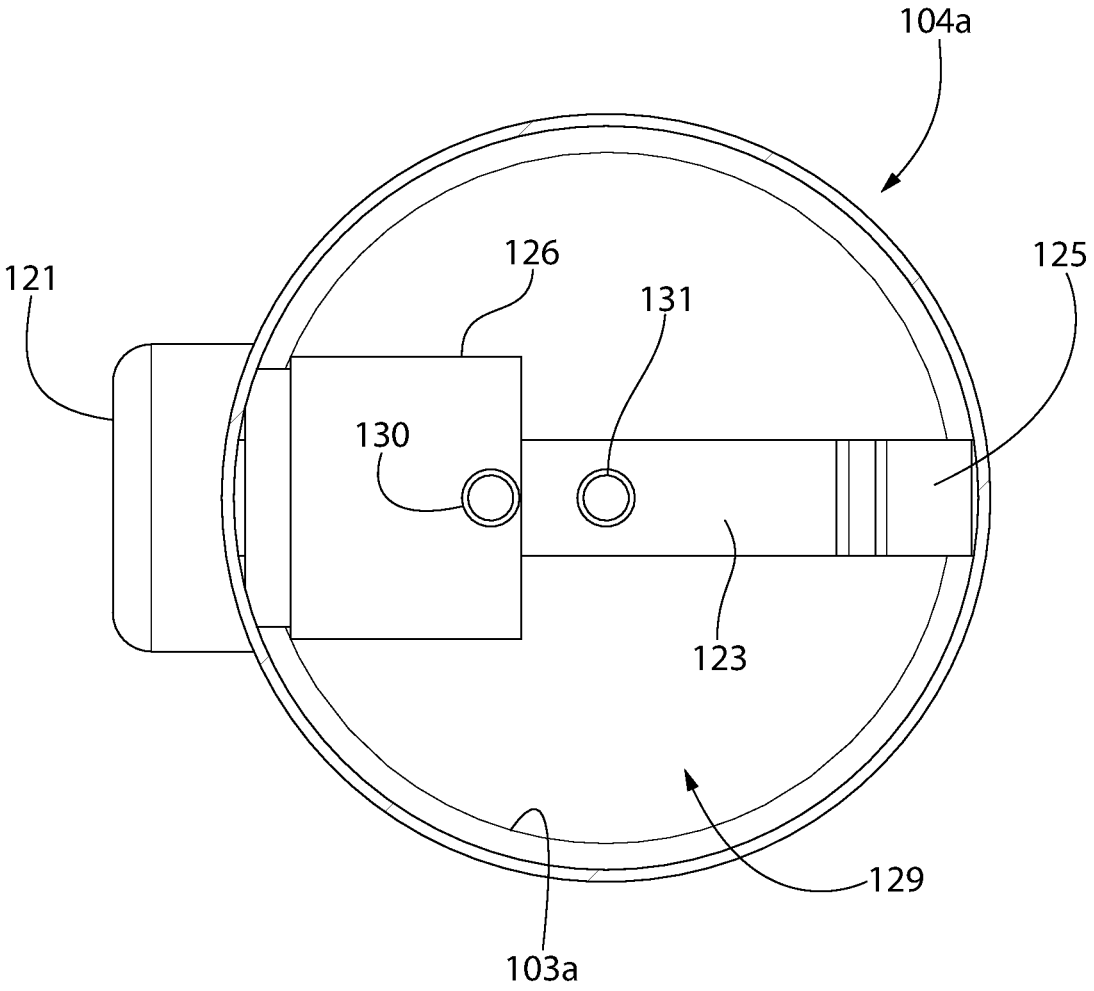
FIG. 14 is transverse cross sectional view taken from FIG. 12 showing elements of the air pump mechanism.
Figure 15:
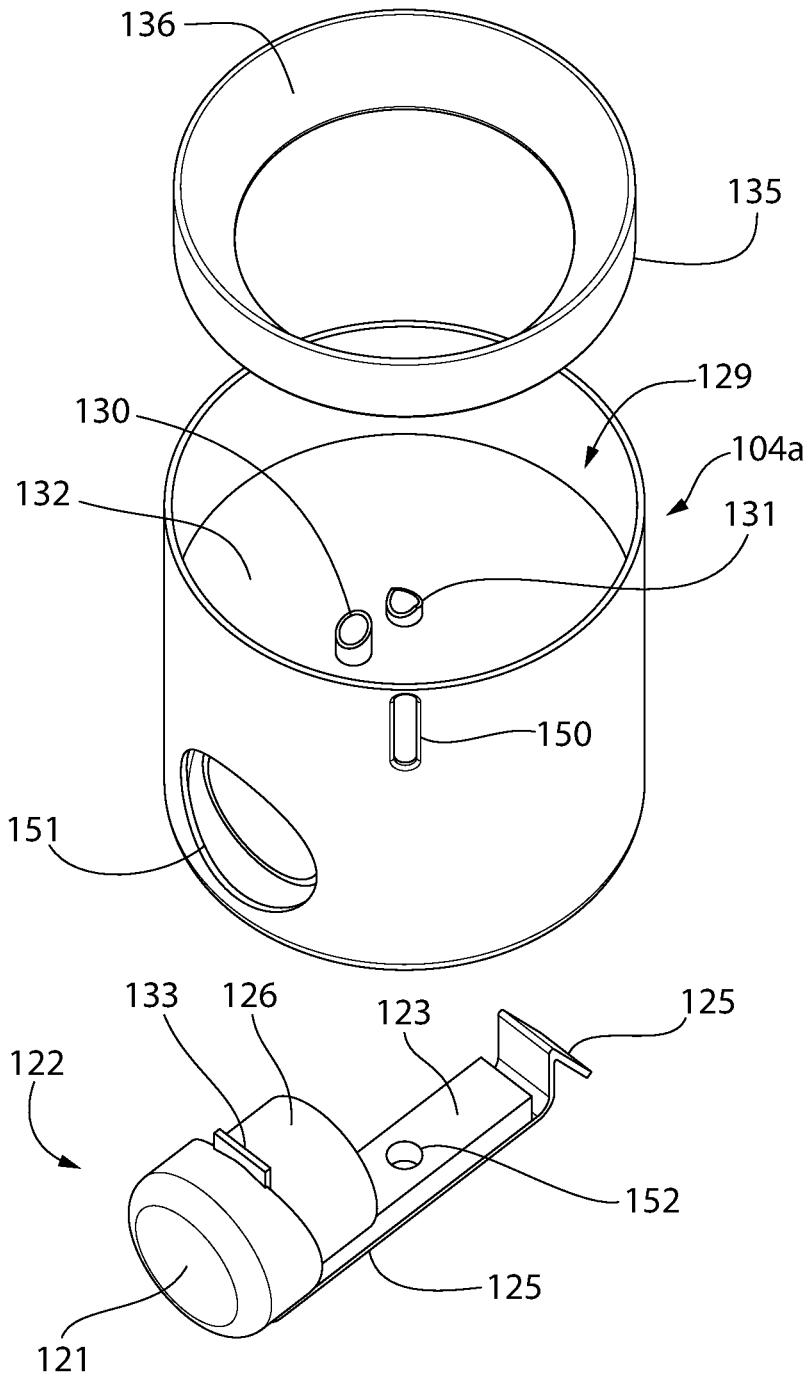
FIG. 15 is a top exploded perspective view of the lower portion of the canister and elements of the air pump of the fluid dispensing mechanism.
Figure 16:
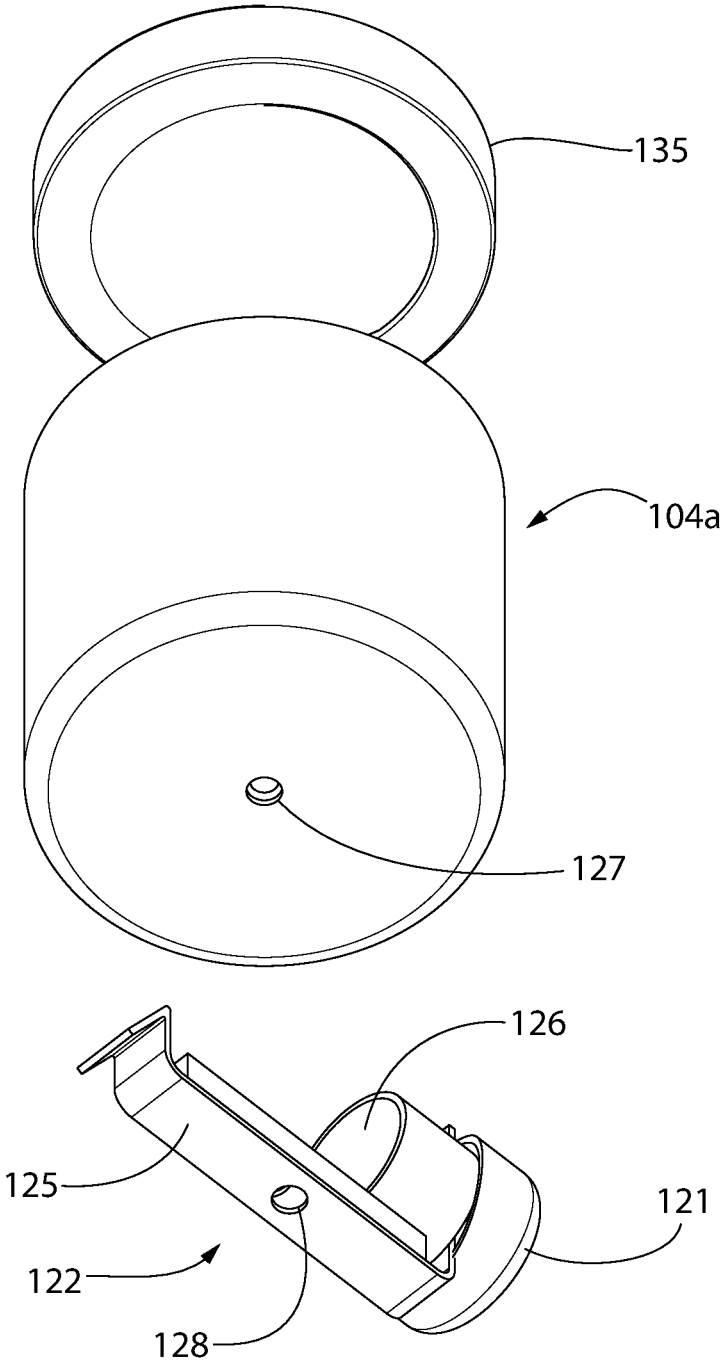
FIG. 16 is a bottom exploded perspective view thereof.
Figure 18:
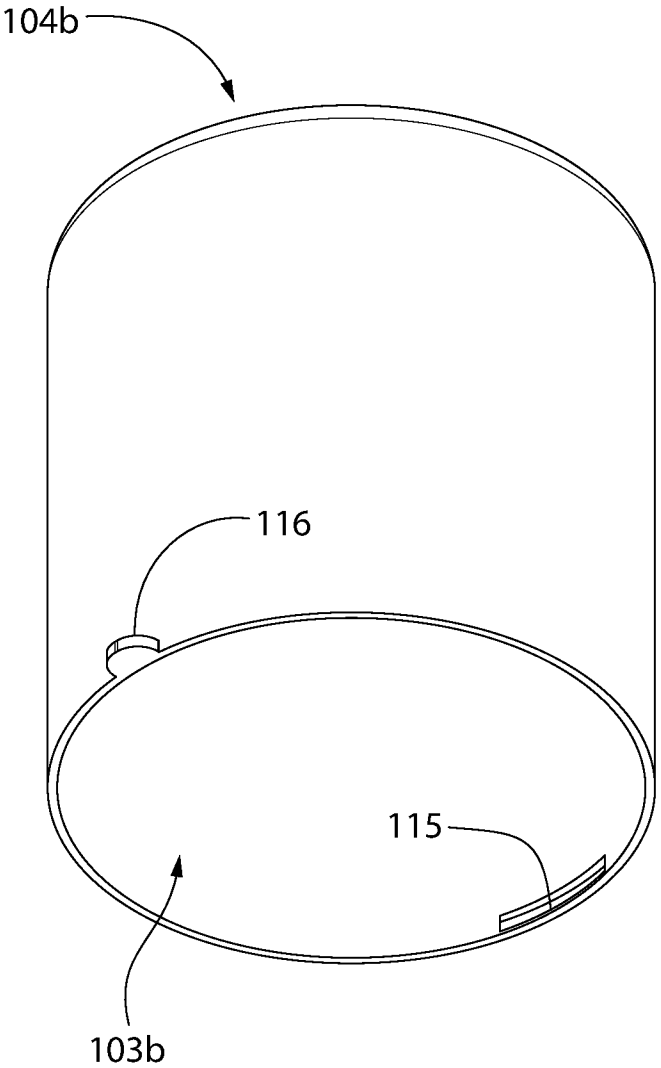
FIG. 18 is a bottom perspective view thereof.
Figure 17:
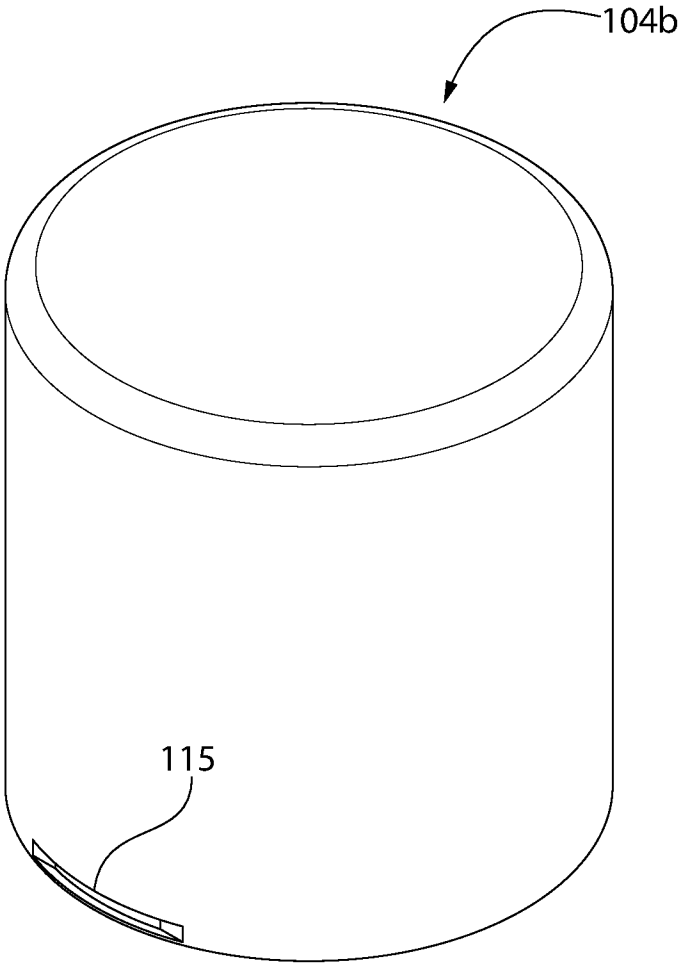
FIG. 17 is a top perspective view of the upper canister section which is coupleable to the shelf unit of FIG. 1.

All drawings are schematic and not necessarily to scale. Features numbered in some figures which may appear in other figures un-numbered are same features unless explicitly noted otherwise herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range.

FIGS. 1-24 show various aspects and features of a fluid dispensing system according to a first embodiment of the present disclosure. The system may comprise a fluid dispenser 100 including a support structure supporting a plurality of fluid dispenser housings. The housings may be container housings which may be in the form of vertically elongated canisters 104 in one embodiment. In one embodiment, the support structure may be a horizontally elongated shelf unit 102 (which may be referred to alternatively as simply a "shelf" herein for brevity). The shelf unit in one construction may have a hollow body 102*a* defining an interior space 102*b* for housing a canister latching mechanism 108, further described herein. The shelf body 102*a* may include a front wall 101*a*, rear wall 101*b*, top wall 101*c*, bottom wall 101*d* and opposing end walls 101*e*. Shelf unit 102 may have a rectangular cuboid configuration as shown; however, other shaped shelf units may be used.

Canisters 104 may be hollow and cylindrical in shape (with circular cross section) in one embodiment; however, other shaped canisters including various polygonal and non-polygonal shapes with corresponding cross sections may be used. Each canister 104 comprises a lower canister section 104*a* fixedly coupled to a bottom wall 101*d* of the shelf unit 102, and a removable upper canister section 104*b* detachably coupled to a top wall 101*c* of the shelf unit. The upper and lower canister sections are coaxially aligned with a vertical centerline Vc that extends through the geometric center of each canister 104. Upper canister section 104*b* defines a top wall 104*c* and lower canister section 104*a* defines a bottom wall of each canister 104. Walls 104*c*, 104*d* may be flat on their exterior sides as shown (see, e.g., FIGS. 4-5).

In one example embodiment, the canisters 104 including the lower and upper sections may be formed of metal, such as without limitation stainless steel for corrosion resistance in humid/wet environments. In other embodiments, plated or enameled metals may be used for the canisters. In yet other embodiments, suitably strong polymeric materials could be used. Shelf unit 102 may be formed of the same or a different material as the canisters.

Where the lower canister section 104*a* and shelf unit 102 are formed of metal, the lower canister section may be welded to shelf unit 102 for a rigid and fixed coupling. The lower canister section 104*a* therefore remains integrally attached to the shelf unit 102 when the fluid containers are replaced.

Each canister section 104*a*, 104*b* is hollow defining an internal cavity 103*a*, 103*b* respectively configured to receive corresponding top and bottom portions of replaceable personal care fluid containers 106 therein. For each canister 104, shelf unit 102 includes an associated circular upper opening 141 formed in top wall 101*c*, and a corresponding circular lower opening 140. The lower opening puts cavity 103*a* of each lower canister section 104*a* in communication with interior space 102*b* of shelf unit 102. Similarly, the upper opening puts cavity 103*b* of each upper canister section 104*b* in communication with interior space 102*b* of shelf unit 102. The openings 140, 141 allow the replaceable fluid containers 106 to extend vertically through the shelf unit 102 to enter the lower canister sections 104*a* as shown.

Personal care fluid containers 106 each define an internal reservoir R which holds a predetermined quantity or volume of personal care fluid 106*a*. Containers 106 may be formed of any suitable material. In one embodiment, containers 106 may be formed of a suitable semi-rigid or rigid plastic (polymeric) material capable of maintaining a self-supported shape. PET (polyethylene terephthalate) is one non-limiting example of a plastic which may be used.

Fluid containers 106 in some preferred embodiments may include a frangible seal 106*b* at the mouth 106*c* (bottom) when inverted and inserted into the canisters 104 for dispensing. Seals 106*b* may be formed of any suitable material capable of being punctured by a sharp object, such as for example without limitation metal foil (e.g. aluminum), polymers, or other materials. The seal may be a separate element affixed to the mouth of the containers 106 by any suitable means (e.g. adhesives), or may be formed as an integral structural portion of the containers from a suitably thin weaker portion of the same plastic used to construct the containers. When the containers are mounted in the fluid dispenser 100, the middle portion of the containers 106 extends vertically through and occupies part of the interior space 102*b* of shelf unit 102 as shown.

In one embodiment, containers 106 may be complementary configured to the canisters 104. Accordingly, in the illustrated embodiment, both the canisters 104 (including lower and upper canister sections 104*a*, 104*b*) and containers may have cylindrical bodies.

Any type of personal care fluid may be stored in fluid containers 106 as previously identified herein. In one embodiment, fluid dispenser 100 may be mounted to a wall of a shower and can concomitantly contain fluids such as shampoo, conditioner, and body wash typically used therein. Other personal care fluids may of course be substituted or used in addition. In other possible embodiments, fluid dispenser may be mounted to a wall in a bathroom near a sink and can contain personal care fluids such as liquid soap, hand lotion, and others. Accordingly, there is no limitation as to where the fluid dispenser can be used and the types of personal care fluids that can be stored and dispensed to the user.

To access the interior of the canisters 104 and shelf unit 102 for inserting and replacing the fluid containers, a spring-biased canister latching mechanism 108 is provided. FIGS. 1-10, 12-13, and 21-24 show various aspects of the canister latching mechanism 108.

Latching mechanism 108 includes a longitudinally elongated latch rod 110 which may have a non-polygonal cross-sectional shape (e.g. circular) as shown, or polygonal cross-sectional shape (e.g. square, rectangular, hexagonal, etc.) in other embodiments. In some embodiments, latch rod 110 may be an elongated rectangular bar in configuration as an example.

Latch rod 110 is slideably supported by guide members 111 affixed to the underside of the shelf top wall 101*c*. The guide members are spaced apart as needed to fully support the latch rod 110. The guide members 111 may be generally U-shaped in one non-limiting embodiment such that the rod 110 may slide back and forth within the guide members. The latch rod may extend for at least the majority of the longitudinal length of the shelf unit 102, and in some embodiments for the entire length of the shelf unit. In certain embodiments as shown, latch rod 110 has a length greater than the length of shelf unit 102 such that a proximal end protrudes outwards beyond one end wall 101*e* of the shelf to form a latch actuator 113 for manually depressing the rod.

Latch rod spring 112 acts on an opposite distal end of latch rod 110 to bias the rod towards an outward latched position. Pushing rod 110 inwards towards the shelf unit 102 against the force of the spring slideably moves the rod to an inward unlatched position. Spring 112 may be a helical compression spring in one embodiment coiled around the distal end of latch rod 110; however, other types of spring may be used to provide a similar function.

Latch rod 110 comprises a plurality of outwardly projecting latch protrusions 114 which selectively engage corresponding latch grooves 115 formed in the bottom rear side of each upper canister section 104*b*. In one embodiment, latch protrusions 114 may be in form of flat tabs extending forward and inwardly from the latch rod. Latch protrusions 114 may be separately attached to the bottom of each upper canister section 104, or formed as an integral unitary structural portion thereof.

Each upper canister section 104*b* has a corresponding latch protrusion configured and operable to lock the upper canister sections to the shelf unit 102. Each upper canister section 104*b* further includes a forwardly and outwardly projecting locking protrusion 116 formed at the bottom front side thereof diametrically opposite to latch groove 115. Locking protrusions 116 are configured to engage the underside of the shelf top wall 101*c* at the circular upper opening 102*c* of shelf unit 102. The locking protrusions 116 may be in the form of flat tabs or flanges which may be separately attached to the bottom edge of each upper canister section 104, or formed as an integral unitary structural portion thereof. In one embodiment, locking protrusions 116 may be arcuately rounded tabs or flanges (one on each upper canister section 104*b*).

Figure 21:
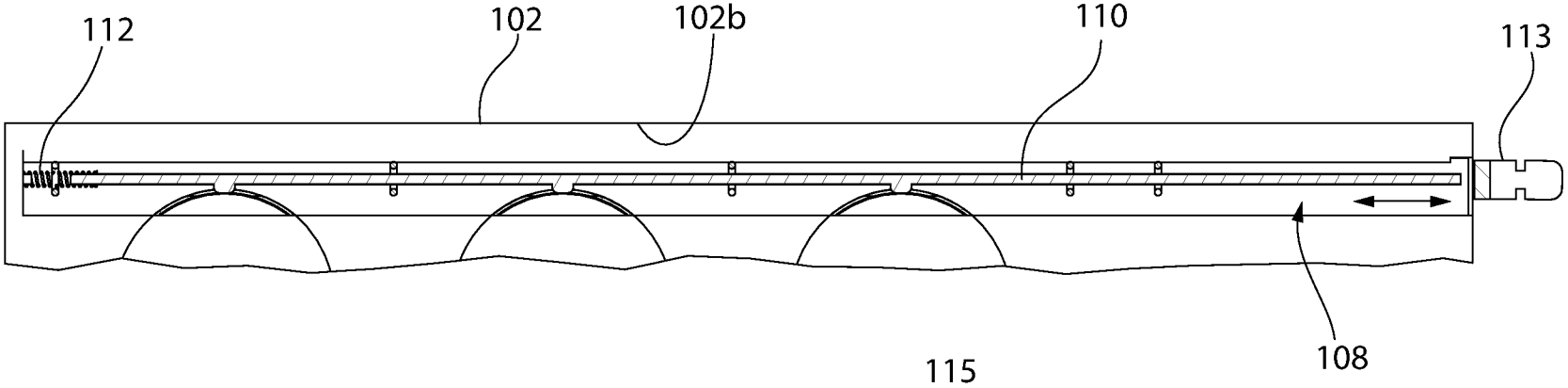
FIG. 21 is a longitudinal cross sectional view of the shelf unit showing a latching mechanism according to the present disclosure.
Figure 22:
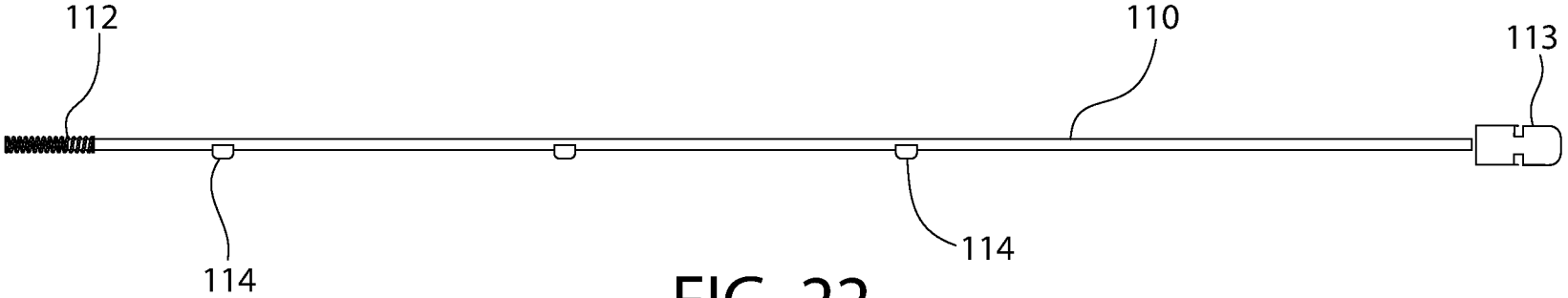
FIG. 22 is a view of the latch rod thereof.
Figure 23:
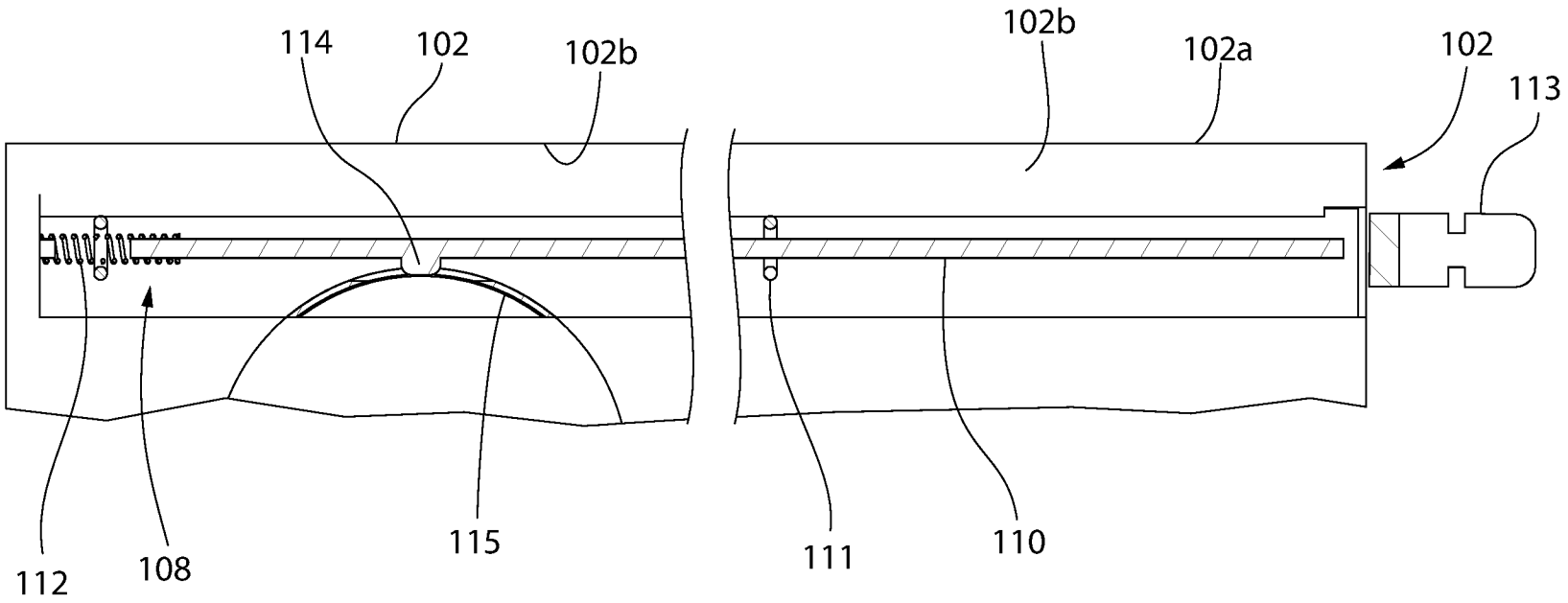
FIG. 23 is a close-up view of the lathing mechanism.
Figure 24:
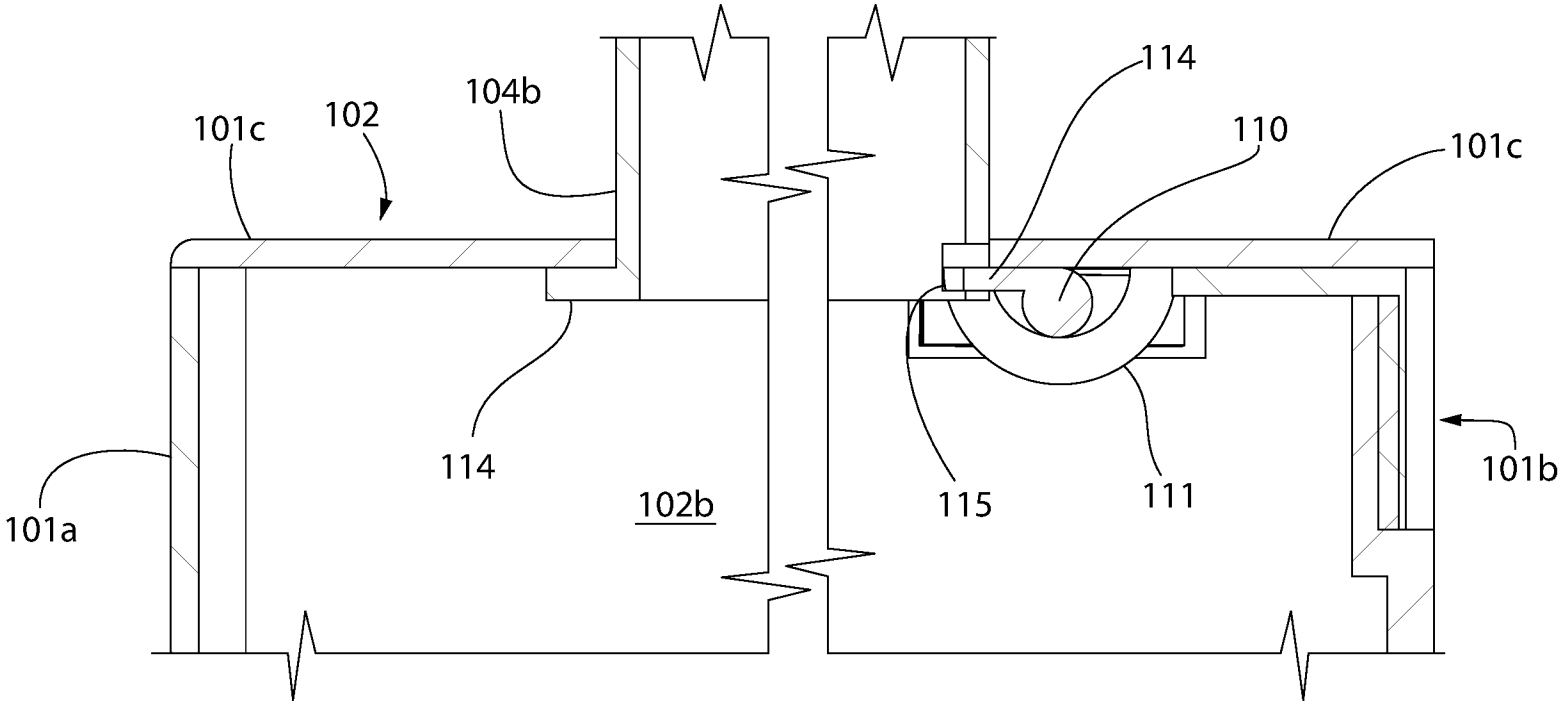
FIG. 24 is a transverse cross sectional view of the latching mechanism.
Figure 25:
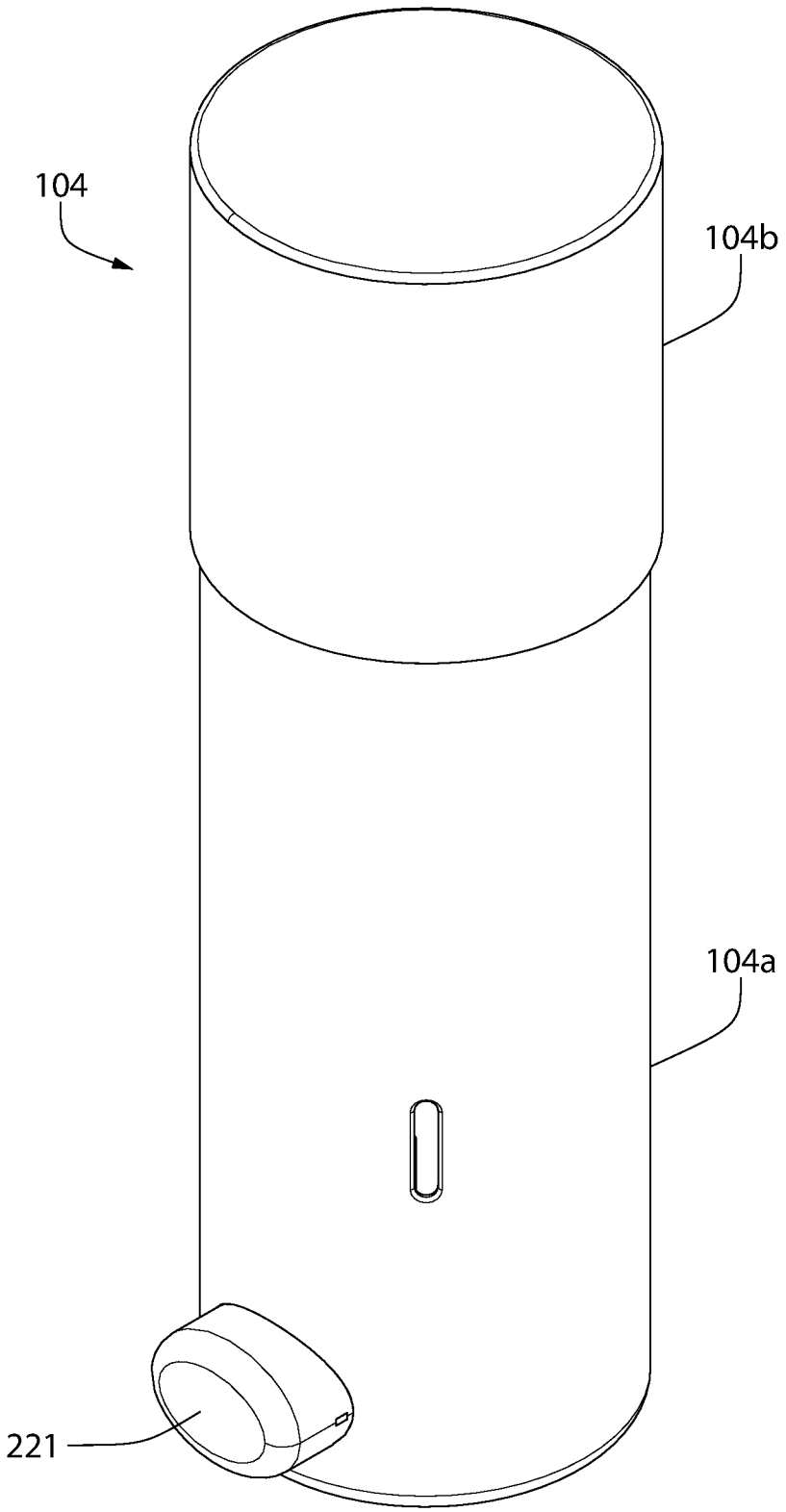
FIG. 25 is a top perspective view of a second embodiment of an air-assisted/gravity-feed manually-operated fluid dispensing system according to the present disclosure showing a fluid dispensing canister thereof.

FIGS. 21 and 23 show latching mechanism 108 in the outward latched position engaged with one of the upper canister sections 104*b*. Locking protrusion 116 is engaged with shelf unit 102 at the front of upper opening 102*c*. Latch protrusion 114 on latch rod 110 is engaged with a latch groove 115 of the upper canister section adjacent to the rear of the upper opening 102*c* of the shelf.

To remove the upper canister section 104*b* shown for replacing the fluid container 106, the user manually presses the protruding latch actuator 113 on the proximal end of latch rod 110 inwards which slideably moves in a linear manner to the inward unlatched position. The latch protrusions 114 simultaneously disengage the corresponding latch grooves 115 on each upper canister section 104*b*, thereby freeing the canister sections. The upper canister sections 104*b* are then each tilted forward which raises and removes the bottom rear end of the canister sections out of their corresponding upper openings 102*c* in shelf unit 102. One or all of the upper canister sections 104*b* may now each be completely removed from the shelf by disengaging the front locking protrusions 116 from the shelf. The empty fluid containers 106 that need to be replaced may now be removed from the shelf unit 102.

After a new full container(s) is/are inserted into the shelf unit, the upper canister sections 104*b* which were removed may be replaced and relocked/relatched to the shelf unit by reversing the process described above. It bears noting that the latching rod 110 may again be pressed inwards to the unlatched position to remount the upper canister sections 104*b*. Releasing the latching rod automatically returns outward to relatch the canister sections 104 due to the biasing action of spring 112.

The pressurized air fluid dispensing system will now be further described. Referring in general to FIGS. 1-24, the fluid dispensing system comprises a fluid dispensing mechanism 120 comprising a manually actuated air pump 122 mounted in the lowermost portion of cavity 103*a* of lower canister section 104*a* which defines a pump housing 129. Pump housing 129 is separated from upper portions of the cavity 103*a* by a horizontal partition wall 132.

Air pump 122 generally comprises a manually operated piston 124 slideably disposed in a cylindrical piston cylinder 126, stabilizer strip or block 123, and pump spring 125. Piston 124 has an elongated hollow cylindrical body comprising an inboard portion 124*a* which slides linearly inwards and outwards inside piston cylinder 126 when the piston is pressed and released, and an outboard portion 124*b*. A captive volume of air is trapped inside the cylinder 126 and piston body which is pressurized and displaceable upon operation of the piston, as further described herein. Outboard portion 124*b* of piston 124 projects outwards from lower canister section 104*a* (i.e. pump housing 129) through frontal opening 151 therein and is enlarged to define an actuator button 121 configured for pressing by a user. Button 121 has a bulbous cylindrical shape with outward flat face for engaging the users finger or thumb to dispense fluid. Other shaped actuators including pivotably movable levers coupled to piston 124 may be used in other embodiments to operate the air pump 122 in a similar manner to that described herein.

Spring 125 biases the piston 124 and actuator button 121 outwards. The spring may be a horizontally elongated flat spring in one embodiment having a resiliently deformable folded end braced against the inside of lower canister section 104*a* in the pump housing 129 opposite the piston 124. In one embodiment, the horizontal portion of the flat spring body is extends across the entire bottom of the pump housing 129 from rear to front and is fixedly coupled to the piston 124 adjacent to actuator button 121. Accordingly, pushing actuator button 121 inwards compresses the spring 125 (i.e. folded end) and releasing the button allows the spring to expand. The horizontal portion of spring 125 therefore slideably moves across the bottom of the pump housing 129 in lower canister section 104*a*.

Actuator button 121 of the air pump 122 includes an upstanding flange 133 located inside the front of lower canister section 104*a* inside pump housing 129. Flange 133 prevents the piston 124 from being ejected outwards by spring 125 through an opening 151 in the front of lower canister section 104*a* (pump housing 129) for the actuator button 121. In one embodiment, flange 133 may be formed by a vertical unitary structural part of the monolithic body of spring 125.

Stabilizer block 123 supports piston cylinder 126 which remains stationary as the piston 124 moves inwards and outwards relative to the lower canister section 104*a*. The horizontal portion of spring 125 is held in place and trapped between the stabilizer block 123 and bottom of the pump housing 129. In one, stabilizer block 123 may be fixedly attached to the pump housing such that the fluid dispensing tube 131 remains stationary while the piston and spring translate inwards/outwards horizontally in the housing. Stabilizer block 123 may be formed of plastic in one embodiment; however, other suitable materials including metal may be used.

A lower end of a fluid dispensing tube 131 is supported by and embedded in a complementary configured passage 152 of stabilizer block 123. A dispensing hole 127 formed in the bottom lower canister section 104*a* is concentrically aligned with the open bottom end of the dispensing tube 131. The top end of the dispensing tube extends vertically upwards and penetrates through partition wall 132 protruding above the wall for a distance. This places the dispensing tube 131 in fluid communication with the upper portion of canister cavity 103*a* above the partition wall, and contents of personal care fluid container 106 when inserted into canister 104. Fluid dispensing tube 131 is straight and therefore insertable inside the fluid container to form a fluid passageway between the fluid container and the dispensing hole 127.

The horizontal portion of spring 125 defines a spring flow hole 128 formed therethrough which is selectively alignable with dispensing hole 127 formed in the bottom lower canister section 104*a* and dispensing tube 131 to dispense fluid from the container 106 when the piston (i.e. actuator button 121) is manually actuated. When the actuator button 121 is in the outward position and the piston is not actuated, the spring flow hole 128 is misaligned with dispensing tube 131 to form a positive seal which shuts off flow of fluid in a manner which prevent drips. Depressing actuator button 121 inwards to actuate the piston and dispense fluid concomitantly compresses and moves the spring inwards as previously described herein. This slides the spring flow hole 128 beneath the dispensing tube 131 to fluidly couple the flow hole, dispensing tube, and dispensing hole 127 in canister 104 together. This established a flow path from the fluid container 106 to atmosphere for vertically dispensing the fluid to the user. Releasing the actuator button 121 expands the spring to reclose the dispensing tube and dispensing hole. This process is repeated each time the user presses and releases the pump actuator button 121.

Fluid dispensing mechanism 120 is configured to pump air into the personal care fluid container 106 and pressurize its contents with each depression of the actuator button 121 for dispensing the fluid to the user. In one embodiment, an air tube 130 is fluidly coupled between the piston cylinder 126 and the upper portion of upper canister cavity 103*b* above partition wall 132. This places the volume of air inside the cylinder in fluid communication with the upper portion of the canister cavity. Air tube 130 extends through and above the partition wall for a short distance, similar to dispensing tube 131 previously described herein. Air tube 130 is insertable into the fluid container 106 and forms an airflow pathway for pumping air from piston cylinder 126 into the fluid container. Both tubes are positioned in the central portion of upper cavity 103*b* above partition wall 132.

In one embodiment, the upper terminal ends of both the air tube 103 and dispensing tube 131 may be angled to puncture a frangible seal 106*b* on the mouth of fluid container 106. When the container is inserted through the shelf unit 102 and into the lower canister section 104*a*, both tubes 130, 131 pierce and puncture the seal. This places the fluid 106*a* contents of the container in fluid communication with the piston cylinder 126 and dispensing tube 131. To help guide and center container when inserted into the canister, a plastic centering ring 135 may be positioned on top of the partition wall 132 in the lower canister section 104*a*. The centering ring may be fixed in place or loosely held therein. Centering ring 135 has a sloping frustoconical shaped guide surface 136 which engages the shoulders of the inverted container 106 to center and guide seal 106*b* onto the air and dispensing tubes 130, 131 for puncturing.

Piston 124 and concomitantly actuator button 121 disposed thereon are moveable together via manually pressing the button between an outward unactuated position (FIG. 19A) and an inward actuated position (FIG. 19B) for dispensing fluid. Moving piston 124 to the actuated position pumps air into the removable container 106 to dispense a portion of the fluid therein.

Operation of the fluid dispensing mechanism 120 will now be briefly described. Once a personal care fluid container 106 is installed in the canister 104 and punctured in the manner previously described herein, the fluid dispenser 100 is ready for operation. To dispense the fluid, the user presses inwards on actuator button 121 of the air pump 122. This results in two actions. First, the spring flow hole 128 in spring 125 moves and becomes aligned with the dispensing tube 131 and dispensing hole 127 in lower canister section 104*a* to open the dispensing pathway. Second, and notably, the piston 124 pumps and forces air within the piston cylinder 126 upwards through air tube 130 and into the container 106 to pressurize its contents. Pressurization of the container forces and expels the personal care fluid through the dispensing tube 131 to the user. A quantity of fluid is thus dispensed from the container each time the actuator button is pushed and pumped. The lower canister sections 104*a* may include vertically elongated observation windows 150 which allows the user to visually check the level of fluid remaining in each container.

It bears noting that the fluid is displaced from the container by the air pumped therein, rather than being drawn out of the container via a fluid pump as in some prior fluid pump designs. No fluid enters the air pump or its components such as the piston 124 or piston cylinder 126 which only come into contact with air. Advantageously, this keeps the air pump clean and free of clogs or accumulations of fluid which could otherwise adversely affect reliable dispensing of fluid.

Although container housings in the form of cylindrical canisters are described herein, other shaped canisters including those with various polygonal or non-polygonal cross-sectional shapes may be used. In addition, although three canisters are shown mounted to the shelf unit herein, any suitable number of canister may be provided. Accordingly, one, two, or more than three canisters can be used.

Although the upper canister sections 104*b* conceal the fluid containers stored therein which might not be aesthetically pleasing in appearance, in some possible embodiments the upper canister sections 104*b* may be omitted. This may be used where the containers have a decorative and pleasing appearance and/or where it might be desirable to display the brand name of the fluid products being offered which may be a high-end product. Although individual upper sections 104*b* are shown, in other embodiments a single larger housing may be provided which is configured to enclose all of the canisters 104 which might be provided.

FIGS. 25-48 depict an alternative embodiment of a fluid dispensing mechanism 220 comprising a manually actuated air pump 222 mounted in the lowermost portion of cavity 103*a* of lower canister section 104*a* that defines pump housing 129 below the partition plate 132. Air pump 222 is somewhat similar to air pump 122 previously described herein in broad concept for injecting a volume of air into replaceable personal care fluid containers 106 seated inside canister 104 to displace and dispense personal care fluid to a user. However, the pumping mechanism in air pump 222 is different in design.

Piston-like acting air pump 122 previously described herein uses a piston body defined by actuator button 121 which slideably pumps a captive volume of air is trapped inside piston cylinder 126 into the fluid containers 106 to displace and dispense the personal care fluid. In the present air pump 222 embodiment, however, actuator button 221 actuates a pair of pivotably movable pumping elements 250 which force a trapped or captive volume of air at the rear of the pump housing 129 into the fluid containers, as further described below.

Figure 46:
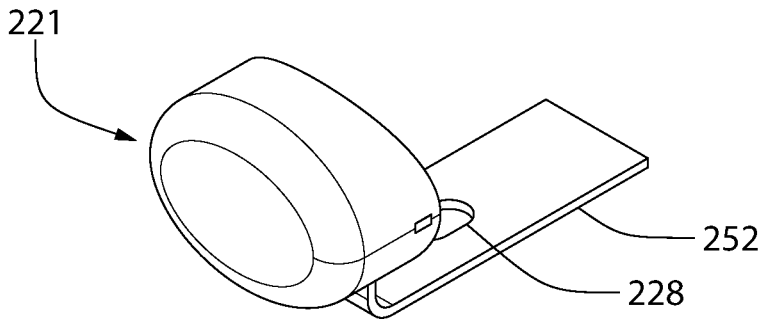
FIG. 46 is a first perspective view of the actuator button of the air pump.
Figure 47:
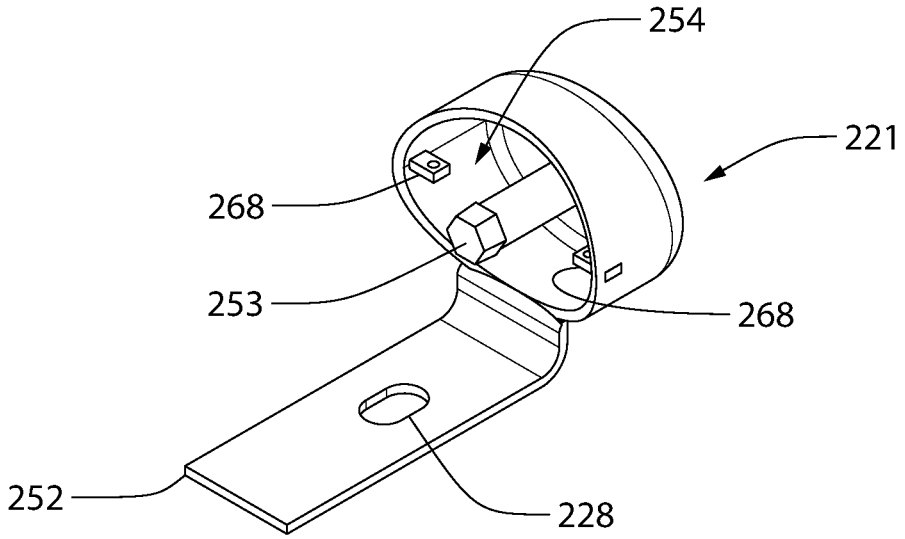
FIG. 47 is a second perspective view of the actuator button of the air pump.

Actuator button 221 is slideably disposed in the front portion of lower cavity 103*a* of the canister 104 for linear forward and rearward movement when depressed by the user to dispense personal care fluid similar to previous actuator button 121. FIGS. 46-47 show the actuator button in isolation and greater detail. Actuator button 221 includes a flattened rectangular baseplate 252 at bottom which is disposed and slideably movable inside canister 104 (i.e. pump housing 129) when the button is manually actuated.

Baseplate 252 extends rearwardly from actuator button 221 when mounted in the canister. The baseplate defines a flow hole 228 which is concentrically alignable with dispensing hole 127 formed in the bottom lower canister section 104*a* and dispensing tube 131 to dispense fluid from the container 106 when the actuator button 221 is manually actuated. When the actuator button 221 is in the outward position and not actuated, the flow hole 228 is misaligned with dispensing tube 131 and dispensing hole 127 to form a positive seal which shuts off flow of fluid in a manner which prevent drips. This dispensing aspect is analogous to the operation of actuator button 121 previously described herein. Flow hole 228 may be oblong and slot-shaped in one embodiment (best shown in FIGS. 27 and 46). As opposed to a circular or round flow hole 228, this advantageously ensures that a majority of the oblong flow hole will be aligned with canister dispensing hole 127 to dispense fluid will even if the user does not fully depress the actuator button to completely align Actuator button 221 is biased towards the outward unactuated position by return spring 255 (see, e.g., FIGS. 27, 28, and 31). Return spring 255 may be a helical compression spring formed of spring metal in one construction. Other type springs may be used. In one embodiment, return spring 255 may be mounted inside a spring tube 254 fixedly disposed inside lower cavity 103*a* of the lower canister section 104*a* proximate to actuator button 221. Spring tube 254 may be fixedly disposed on dispensing tube 131 in one embodiment and formed as an integral unitary structural part thereof. Spring tube 254 is outwardly open and slideably receives a cylindrical spring protrusion 253 extending rearward and inwardly from the rear of the actuator button (see also FIG. 46). When actuator button is pressed inwardly to its actuated position to dispense fluid from personal care fluid container 106, spring protrusion 253 compresses the spring 225. When the button is released, the spring returns the actuator button back outwards to its unactuated position.

Figure 28A:
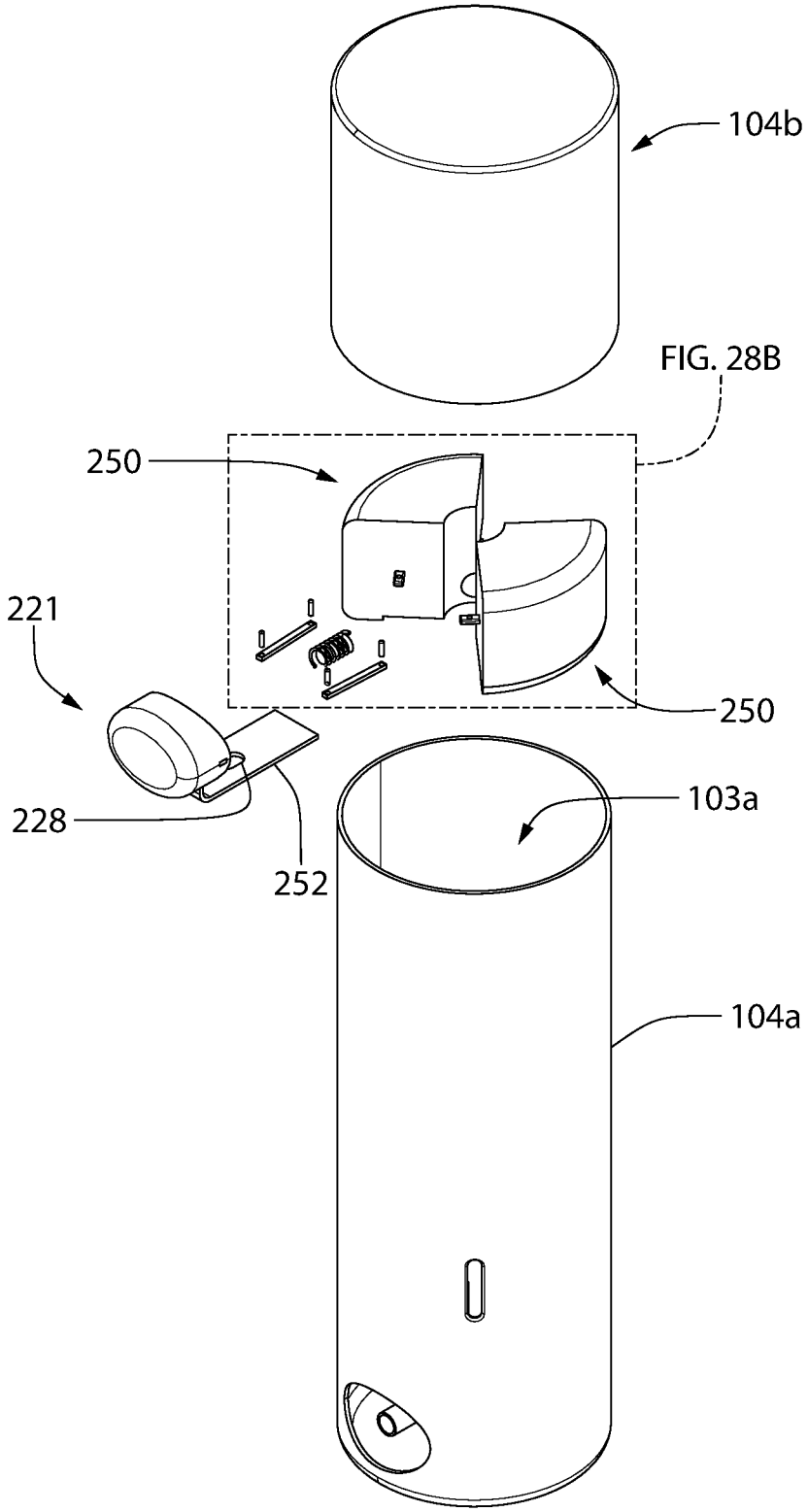
FIG. 28A is an exploded view of the canister.
Figure 28B:
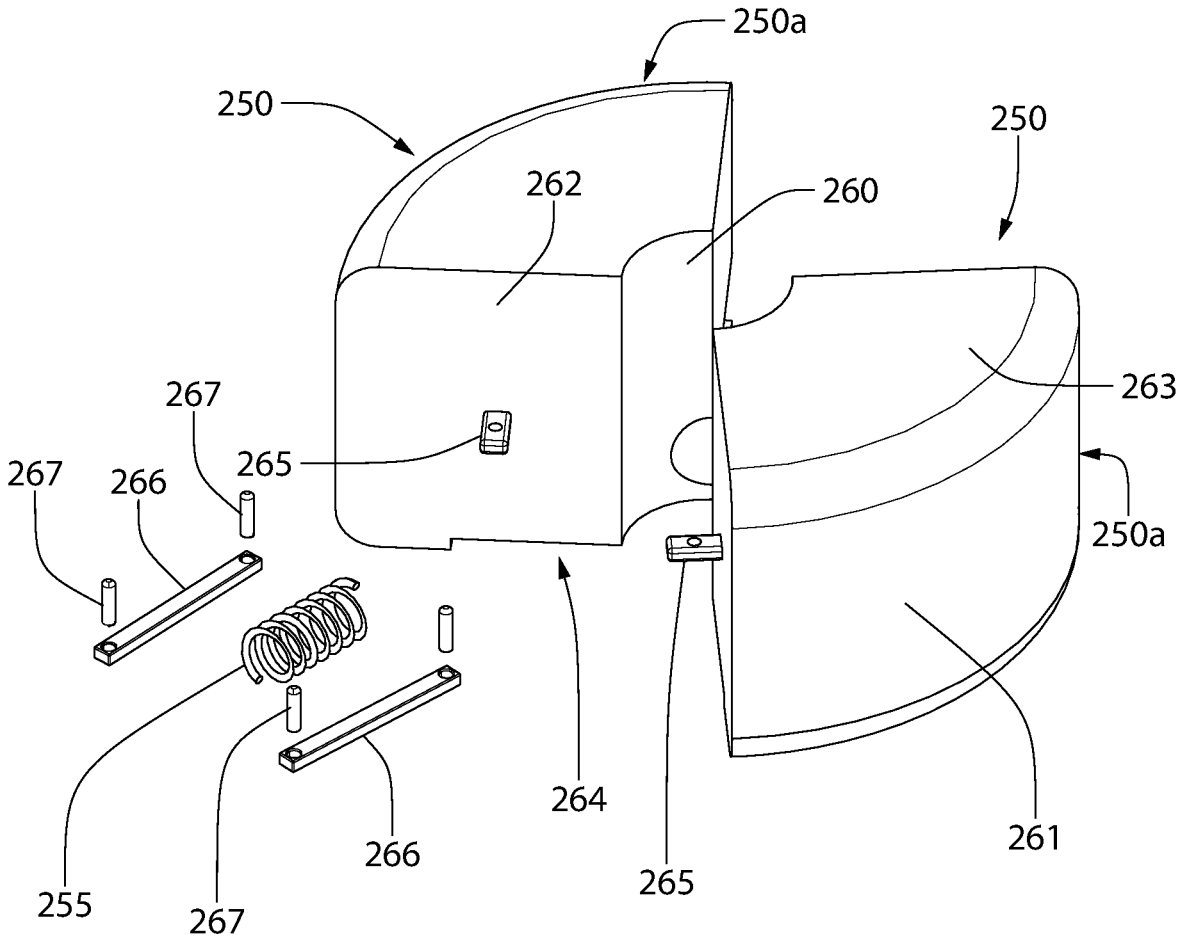
FIG. 28B is an enlarged detail taken from FIG. 28A.

FIGS. 28A-B show the pair of pump elements 250 of air pump 222 in greater detail. Each pump element 250 comprises a wedge-shaped body 250*a* generally forming a sector of a circle when viewed from above. The body of each pump element includes arcuately curved inner and outer surfaces 260 and 261, opposing flat end walls 262, top surface 263, and bottom surface 264. Top surface 263 and bottom surface 264 may be substantially flat in one embodiment and parallel to each other.

In operation, the arcuately curved inner surface 260 of each pump element 250 slideably engages a complementary configured circular and arcuately curved guide tube 265 disposed in the center of lower canister section 104*a* inside the pump housing 129 which is defined by internal cavity 103*a* of the lower canister section (see, e.g., FIGS. 27, 31-33, and 36-40). Guide tube 265 extend circumferentially around and at least partially encircles the air and dispensing tubes 130, 131. The guide tube is concentrically and coaxially aligned with vertical centerline Vc of the canister which extends through the geometric center of the canister. In one embodiment, the circular guide tube 265 may intersect the fluid dispensing tube 131. Guide tube 265 and the air and dispensing tubes 130, 131 in one embodiment may be formed as integral unitary parts of the partition wall 132.

Figure 27:
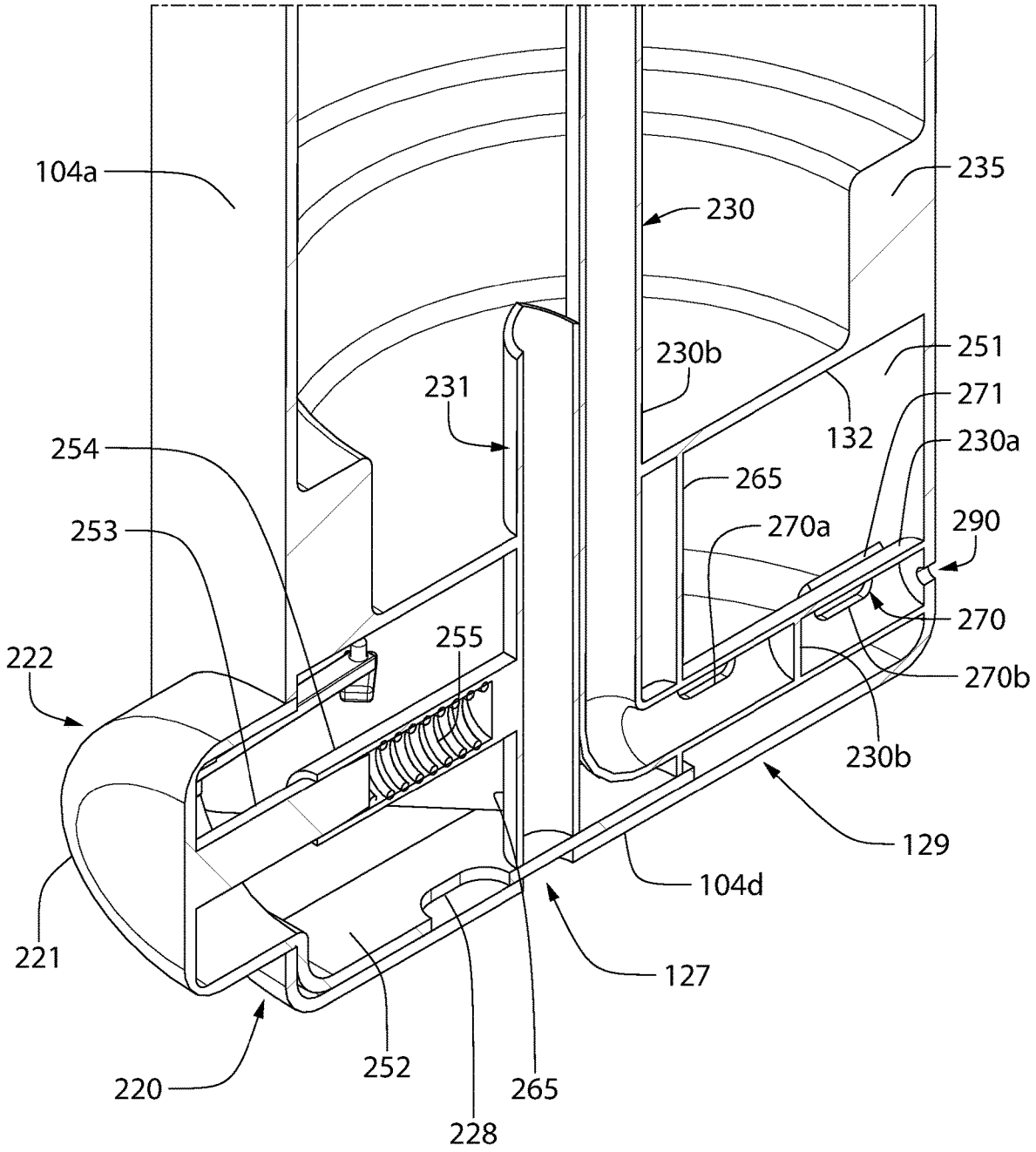
FIG. 27 is an enlarged view taken from FIG. 26 showing the air pump of the fluid dispensing mechanism in greater detail.
Figure 31:
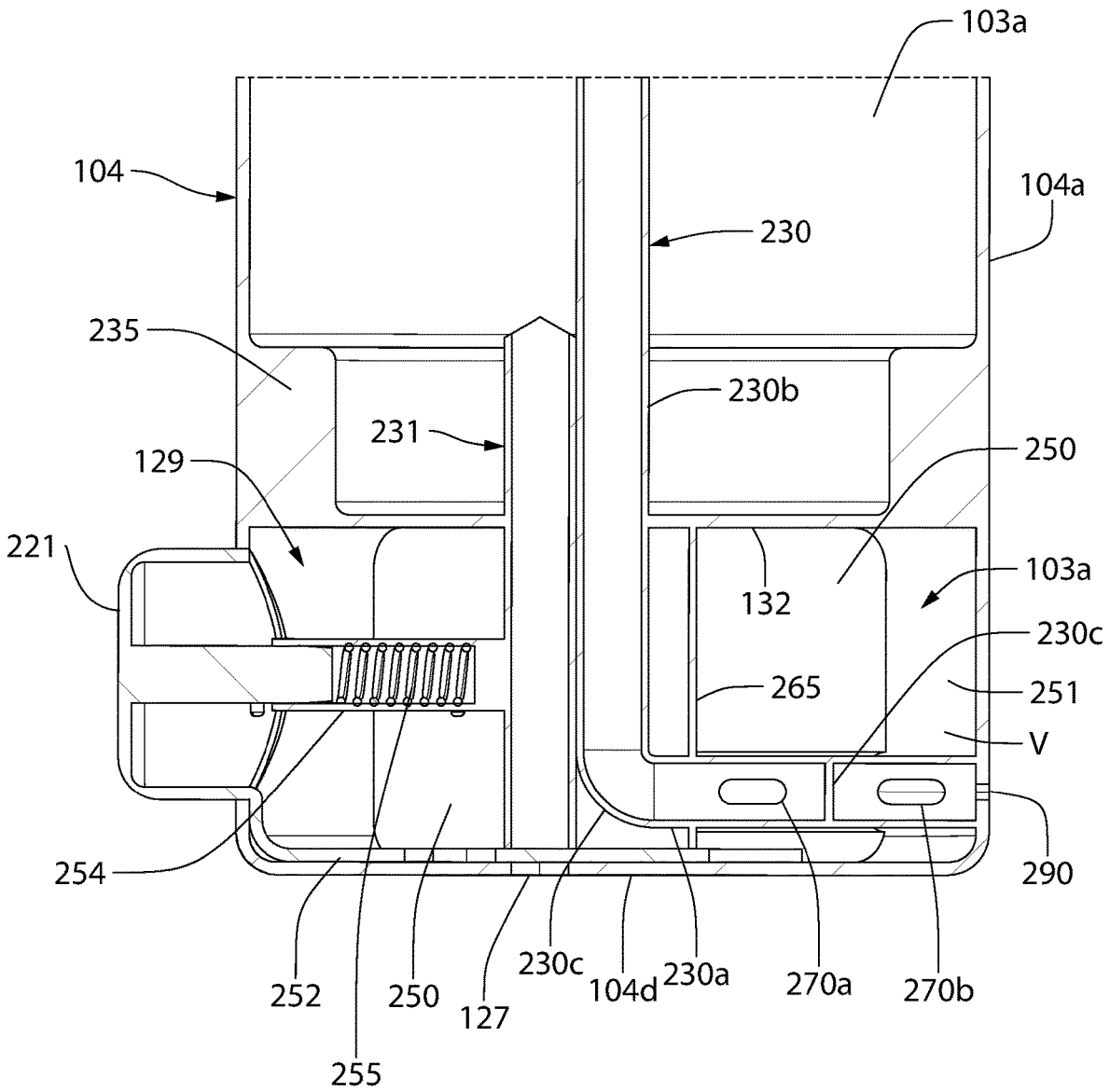
FIG. 31 is an enlarged view taken from FIG. 30.
Figure 32:
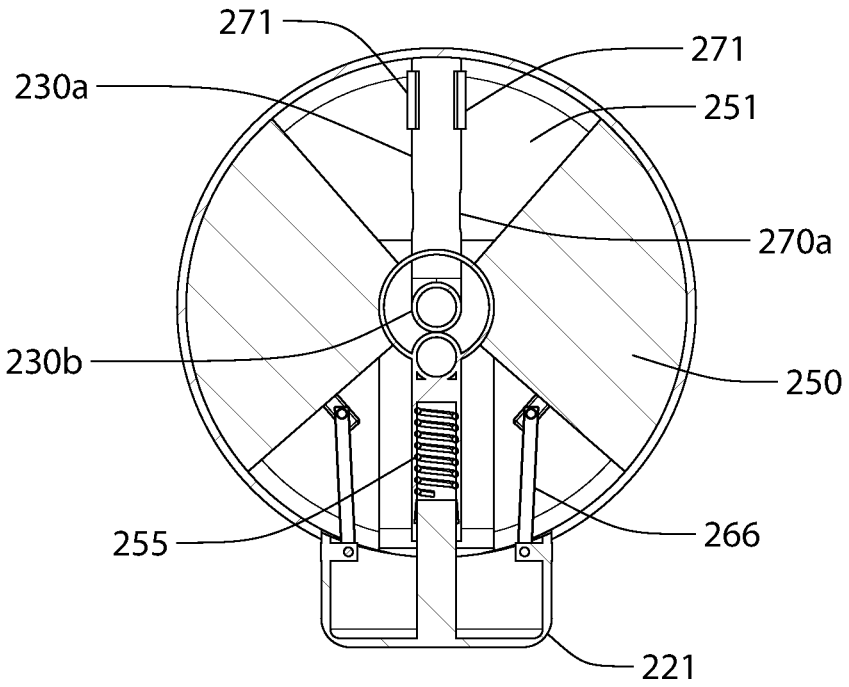
FIG. 32 is a transverse cross sectional view through the air pump mechanism in the pump housing portion of the canister showing the wedge-shaped pumping elements of the air pump in a first unactuated position.
Figure 33:
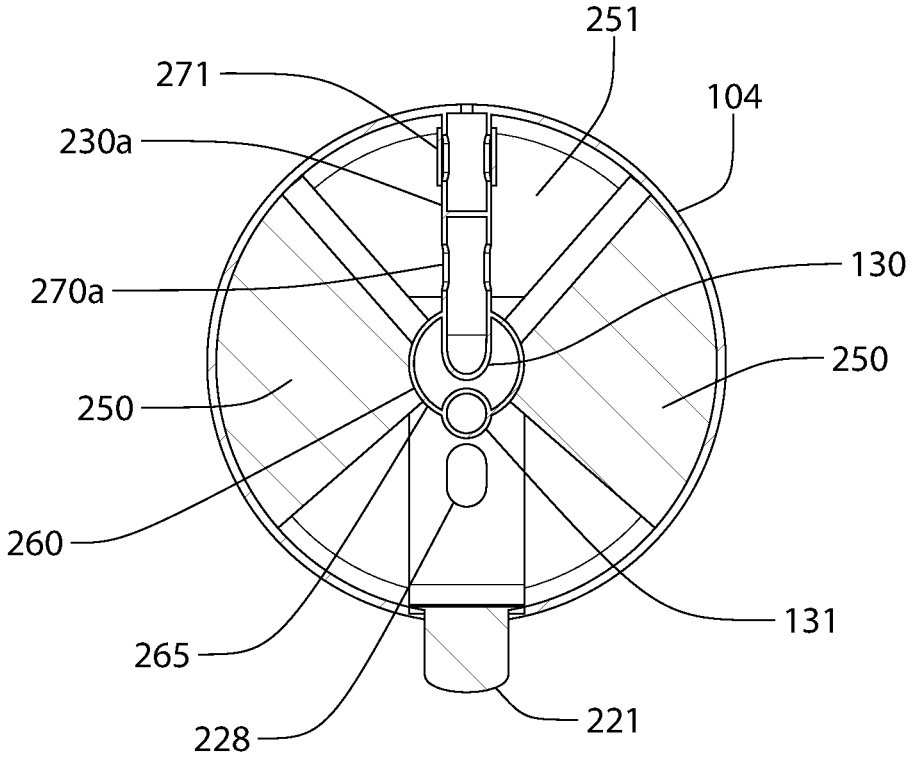
FIG. 33 is a transverse cross sectional view thereof showing the wedge-shaped pumping elements rotated to a second actuated position.
Figure 34:
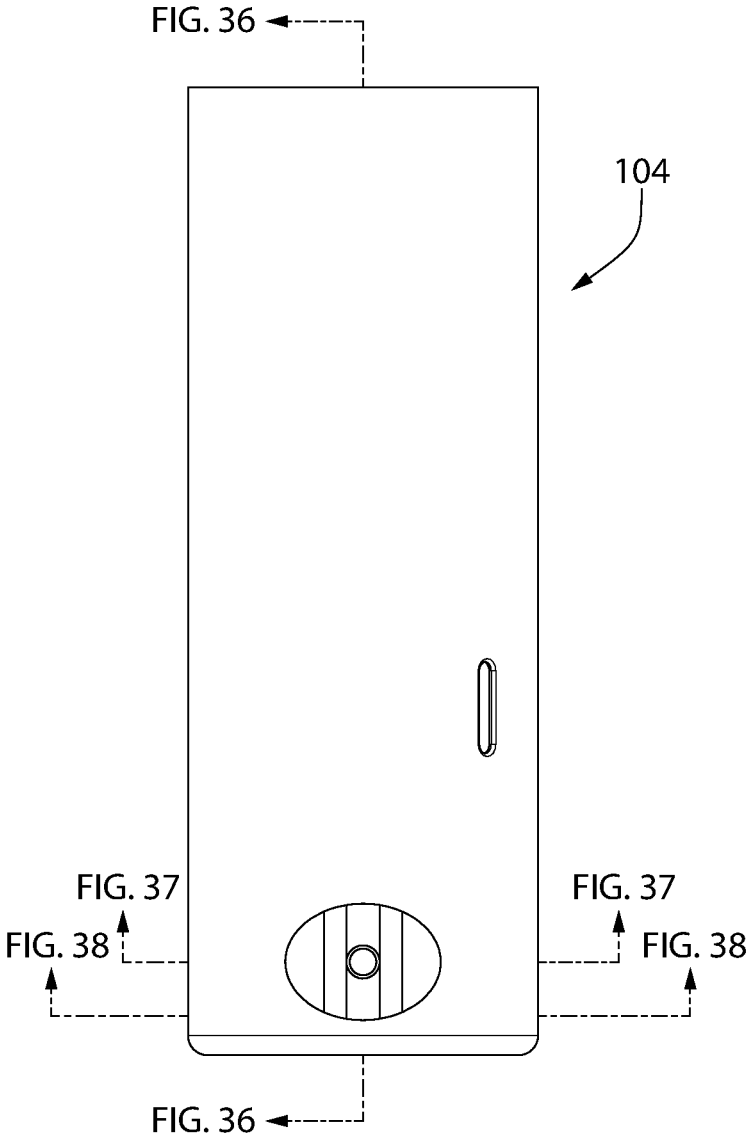
FIG. 34 is a front view of the canister alone without the air pump mechanism installed.
Figure 35:
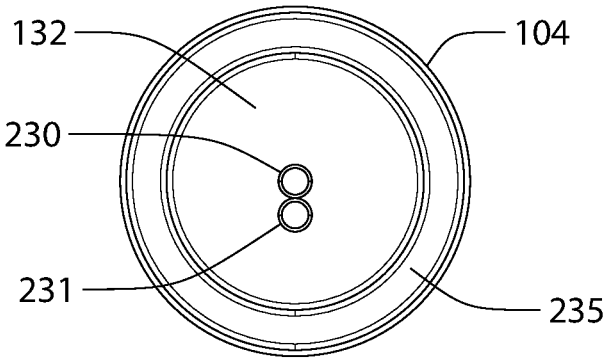
FIG. 35 is a top view thereof.
Figure 36:
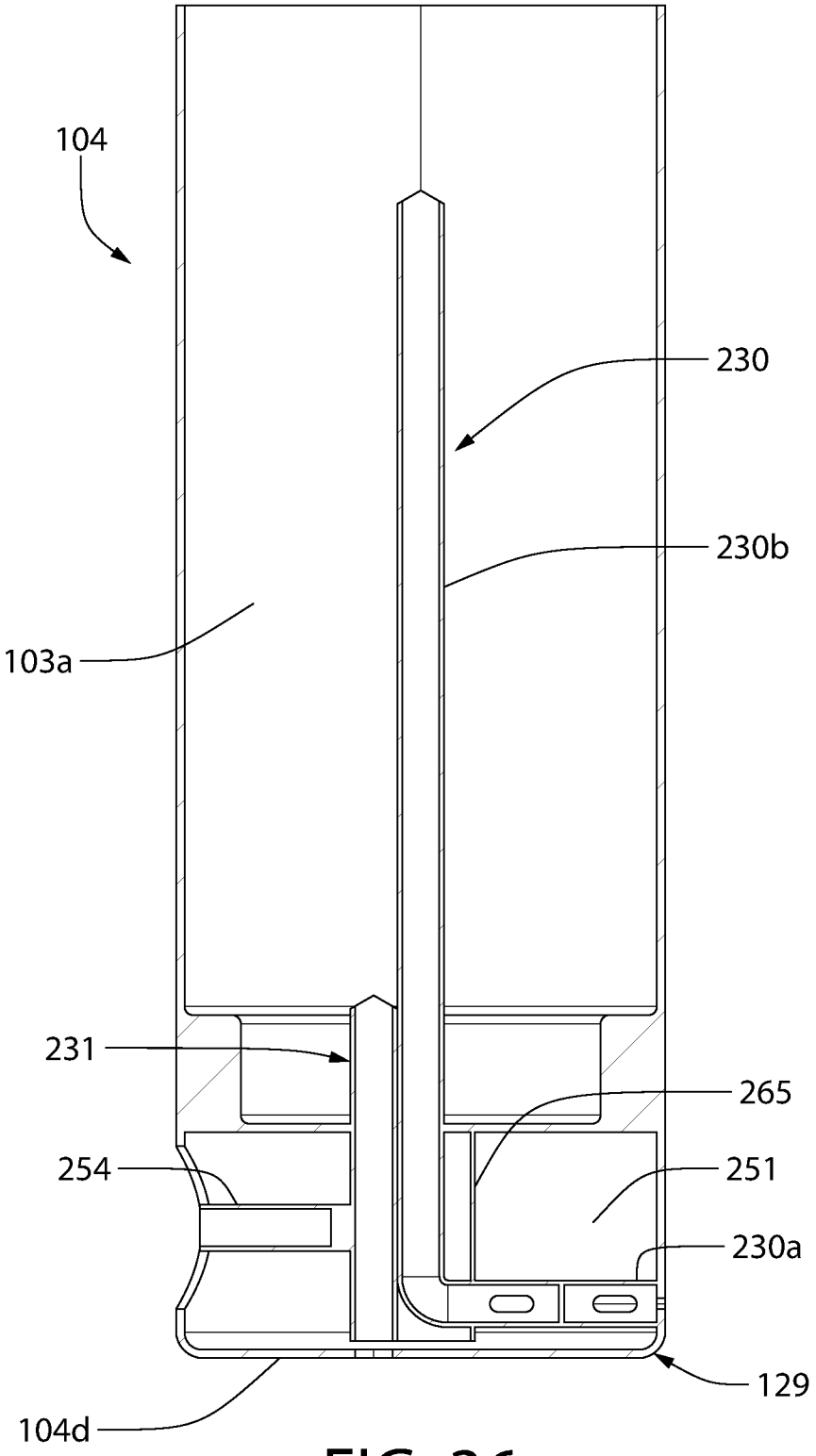
FIG. 36 is a side cross sectional view thereof taken from FIG. 34.
Figure 37:
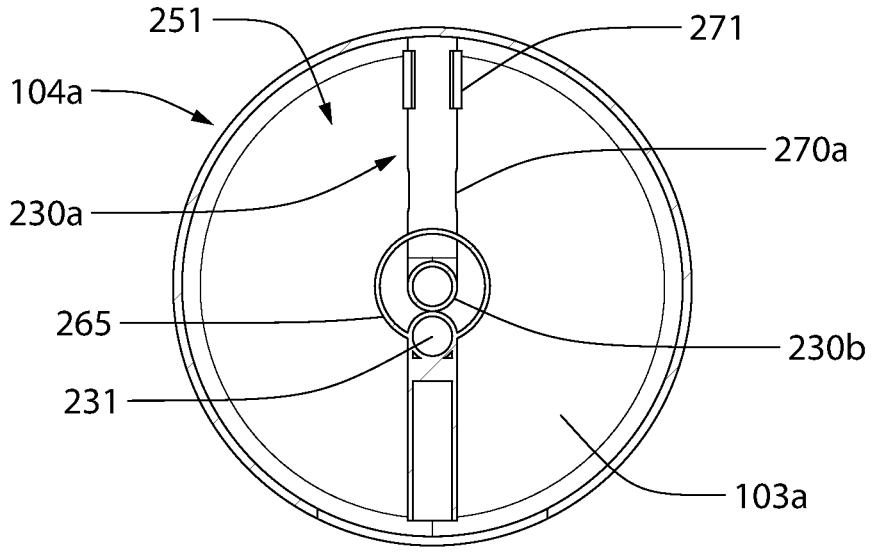
FIG. 37 is a first transverse cross sectional view thereof taken from FIG. 34.
Figure 38:
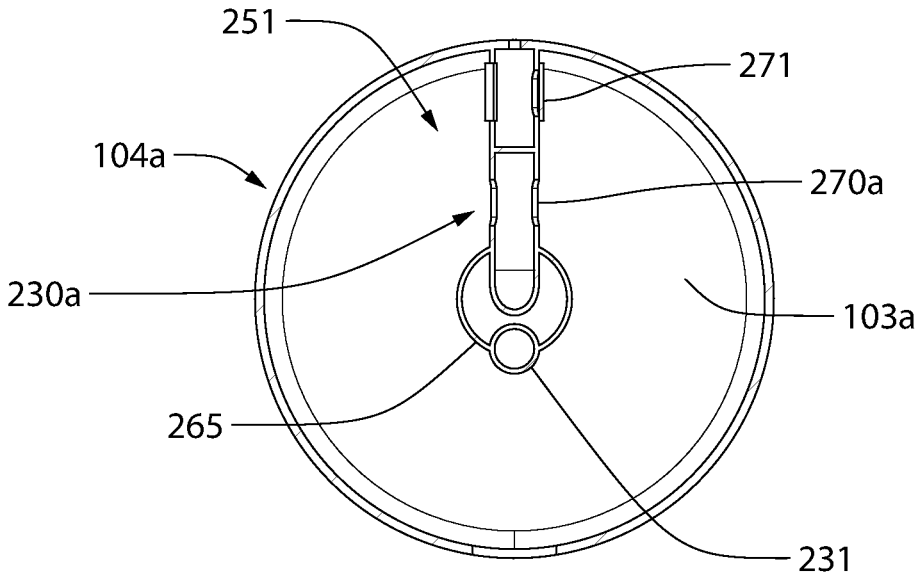
FIG. 38 is a second transverse cross sectional view thereof taken from FIG. 34.
Figure 39:
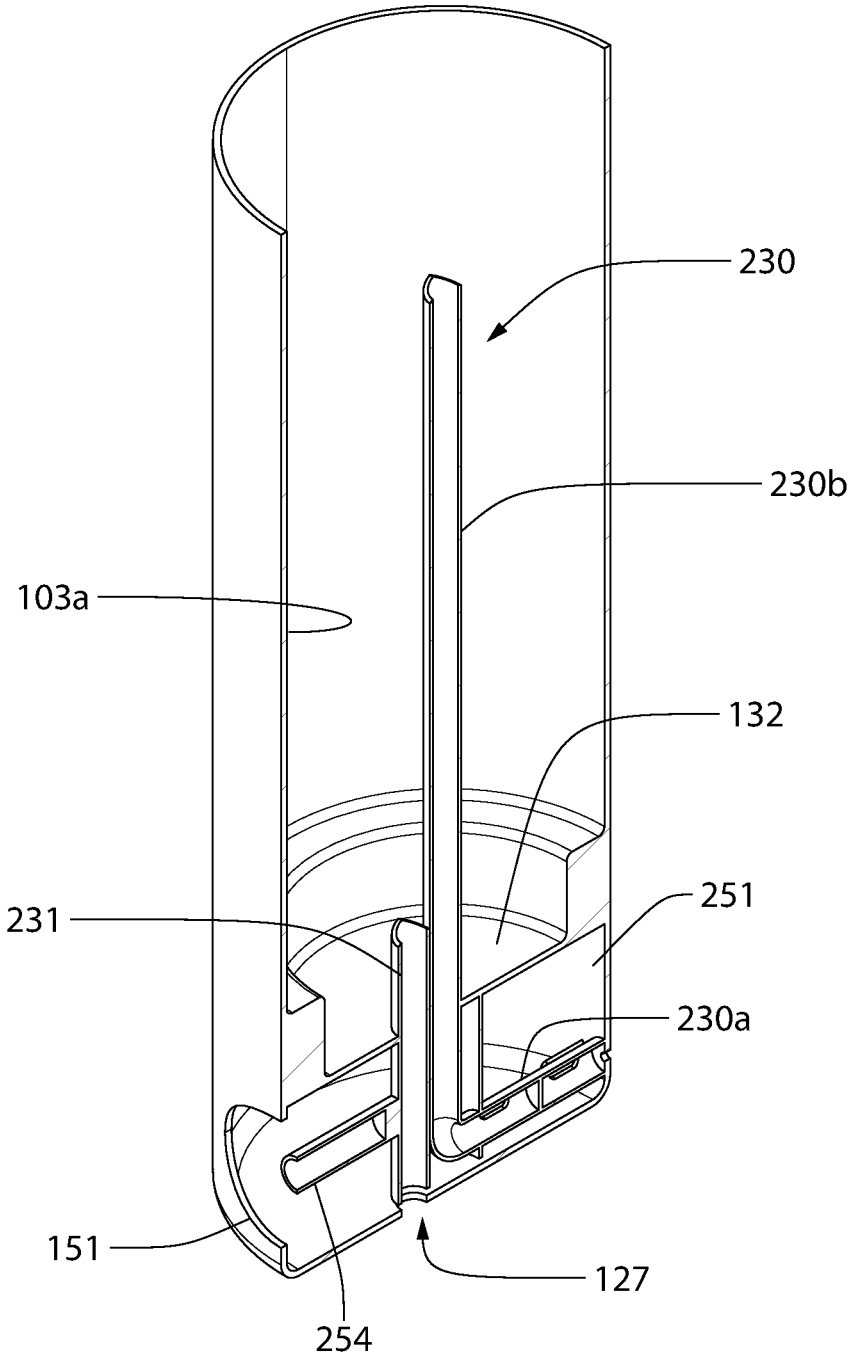
FIG. 39 is a first side perspective cross-sectional view thereof.
Figure 40:
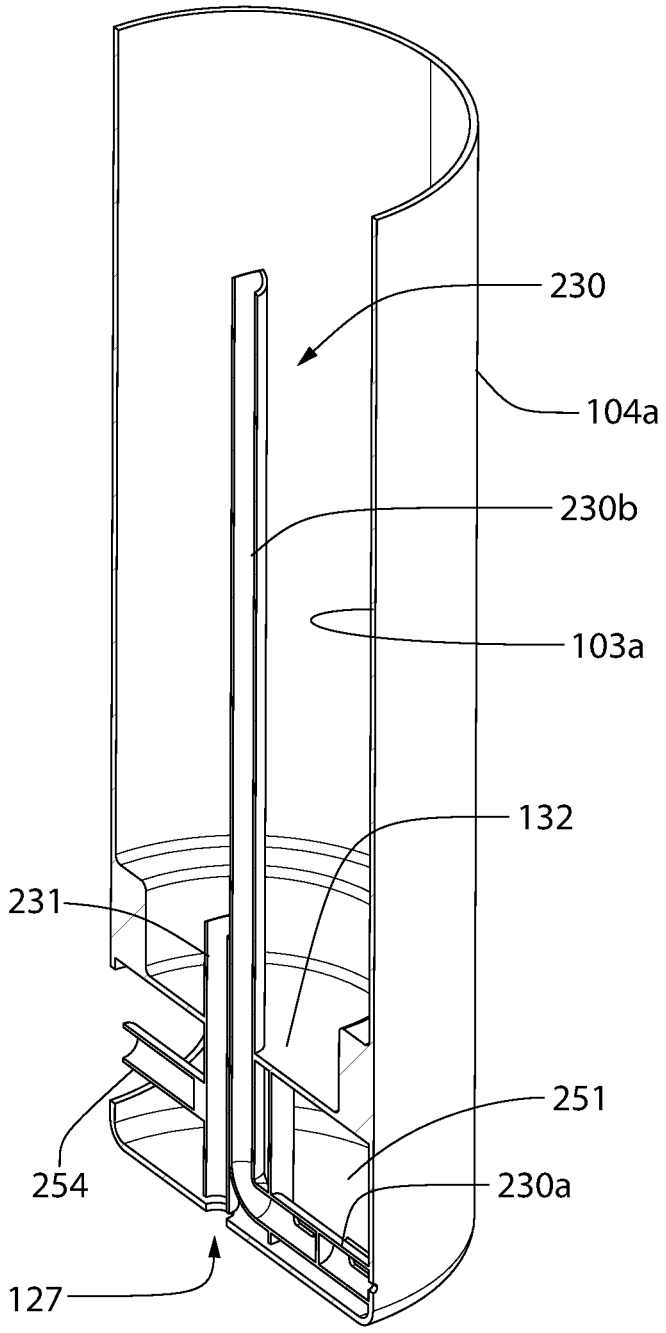
FIG. 40 is a second side perspective cross-sectional view thereof.

The guide tube 265 may extend vertically between the partition wall 132 and bottom wall 104*a* of lower canister section 104*d* for a majority of the height of the pump housing 129/internal cavity 103*a* (see, e.g., FIGS. 27 and 31). In some embodiments, the guide tube may project downwards from partition wall 132 and terminates at its bottom end near but not engaging bottom wall 104*d*. This provides clearance to allow the rectangular baseplate 252 of actuator button 221 to slide back and forth beneath the bottom end of guide tube 265 when the button is actuated to dispense fluid.

An air chamber 251 having variable volume V is defined to the rear of pumping elements 250 in lower canister section 104*a* inside pump housing 129 (cavity 103*a*). The air trapped or captive inside air chamber 251 is expelled and pumped through air tube 130 and into personal care fluid container 106 when installed in the canister. Air chamber 251 thus has an initial volume V1 before the actuator button 221 is actuated (see, e.g., FIG. 43), and a smaller volume V2 after the actuator button 221 is depressed and actuated (see, e.g., FIG. 44) to pump air into the container 106. Air chamber 251 has a generally wedge or triangular shape in transverse cross section as seen in the foregoing figures which is formed by the wedge-shaped pumping elements 250 and cylindrical canister 104; the internal bottom part of which forms the pump housing 129 below the partition wall 132.

To actuate and pivotably move/partially rotate the wedge-shaped pumping elements about vertical centerline Vc of canister 104 and guide tube 265 when actuator button 221 is depressed by the user, a pair of linkage arms 266 may be provided (see, e.g., FIGS. 28A-B and 43-44). The linkage arms may be straight strut-like rigid structures in one embodiment as shown. Each linkage arm 26 pivotably couples the actuator button to one of the pumping elements 250. With additional reference to FIG. 47, one end of each linkage arm is pivotably coupled to the actuator button 221 by pinned connection comprising a tab 268 fixedly disposed on the rear side of the actuator button and a pivot pin 267. The opposite end of each linkage arm is pivotably coupled to the one of the wedge-shaped pumping elements 250 by another pinned connection comprising a tab 265 fixedly disposed on the respective pumping element and another pivot pin 267. Accordingly, each linkage arm 266 has two pivot axes defined by the pinned connections at the ends of each arm. In other words, each linkage arm 266 may be considered to be both pivotably coupled to the actuator button 221 and pivotably coupled to a pumping element 250. The dual-pinned linkage arms 266 transform linear motion of the actuator button 221 when depressed into simultaneous pivotable/rotational motion of the pump elements about vertical centerline Vc of canister 104 and guide tube 265 inside the pump housing 129.

It bears noting that the present fluid dispensing mechanism 220 employing the wedge-shaped pumping elements 250 advantageously has ability to create greater air pressure for applications where needed than the piston version of the dispensing previously described herein. In addition, the sizes of the pumping elements and/or rotational range of movement can be modified as needed to generate proper air pressure and flow to handle different viscosity fluids to be dispenses. For example, some body lotions or hair conditioners are typically thicker in consistency with a higher viscosity than body wash or shampoo. This provides considerable flexibility to customize the fluid dispensing mechanism to handle a range of fluids and viscosities. It also bears noting that where multiple fluid dispensing canisters 104 are used with shelf unit 102 or other type support structure, different size pumping elements 250 and/or ranges of motion may be used in each canister depending on the nature of the personal care fluid being dispensed.

Similarly to air tube 130 previously described herein, the present air tube 230 is insertable into the fluid container 106 and forms an airflow pathway for pumping air from the air chamber 251 in this embodiment into the fluid container. Fluid dispensing tube 231 fluidly couples dispensing hole 127 in the lower canister section 104*a* to the fluid inside fluid container 106 through the frangible foil seal 106*b* on the container, similarly to fluid dispensing tube 131 previously described herein.

Figure 19A:
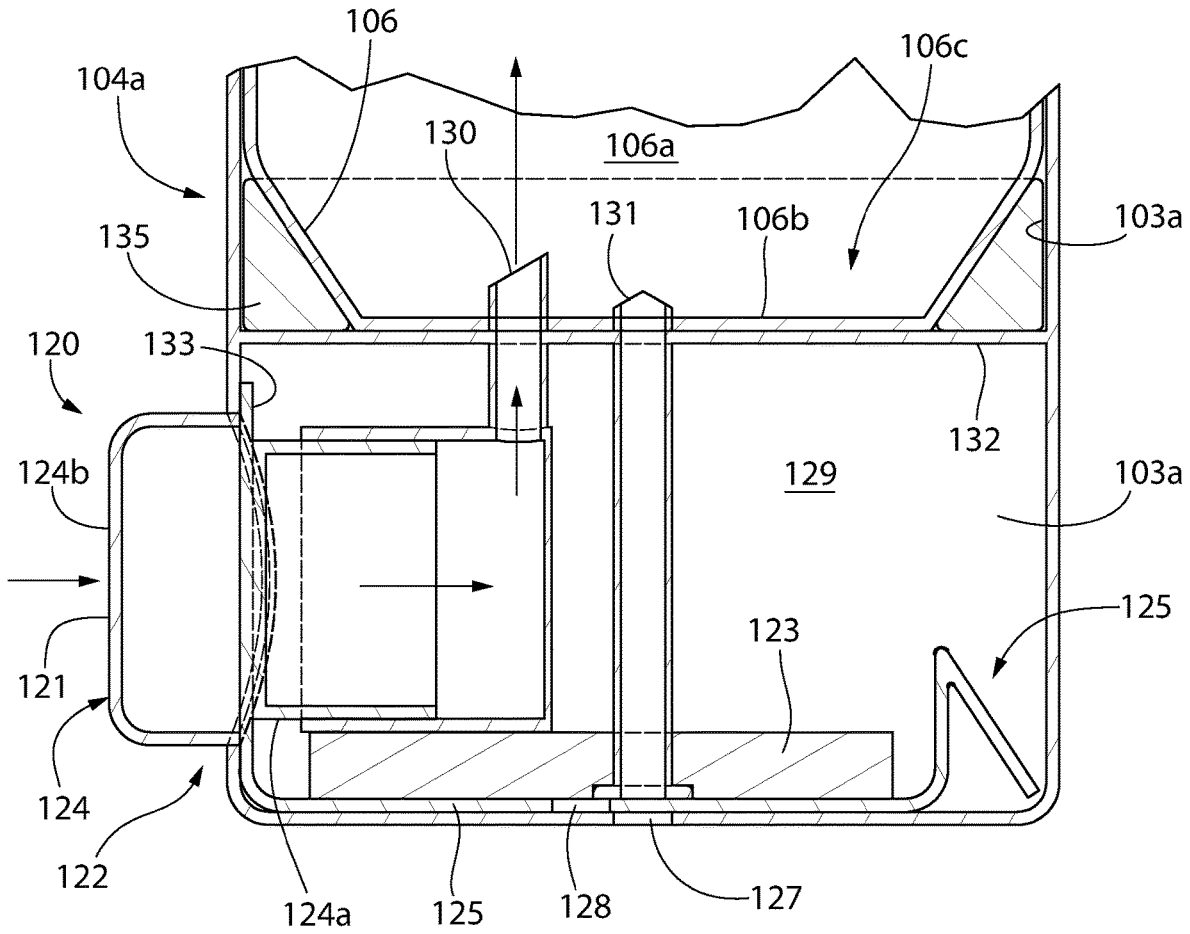
FIG. 19A is side transverse cross sectional view of the fluid dispensing mechanism in an unactuated position.
Figure 19B:
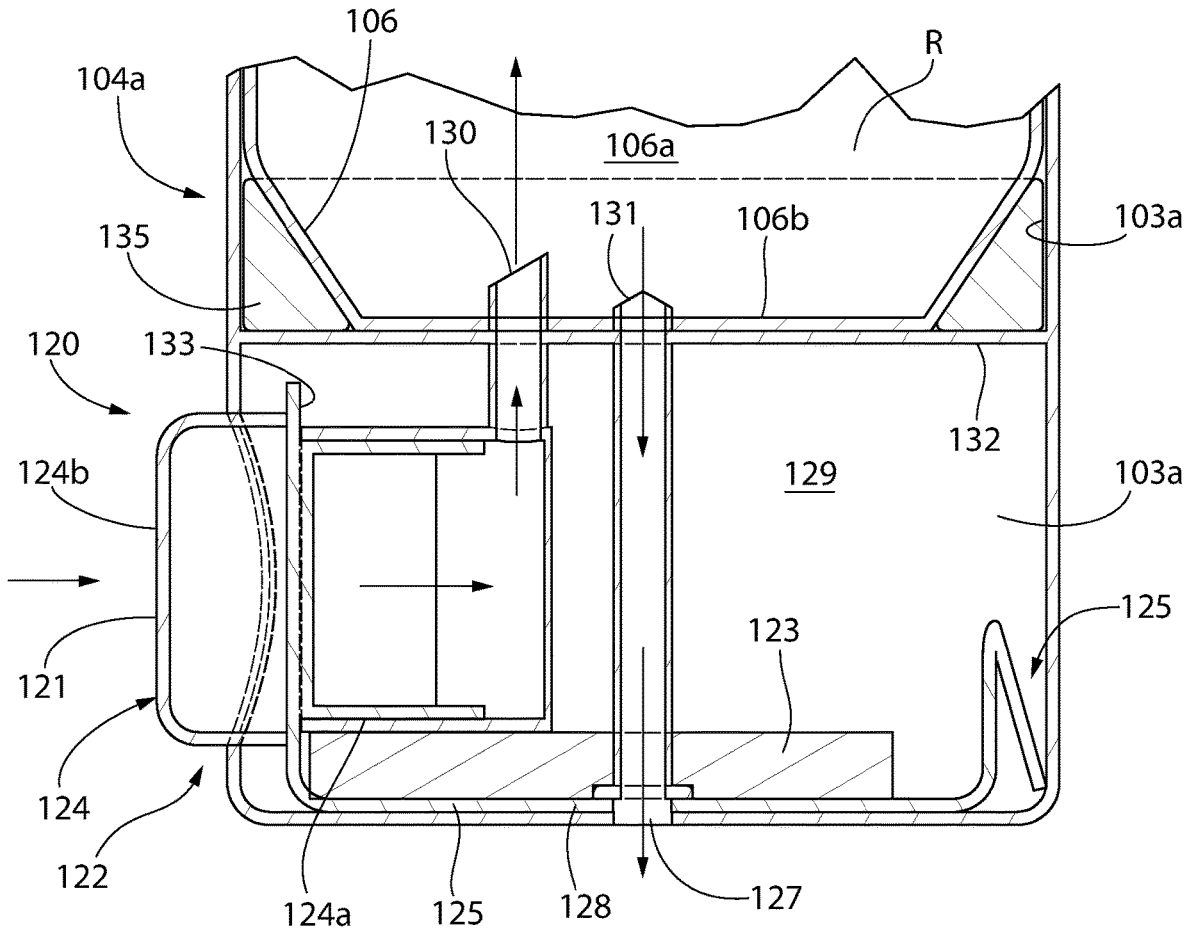
FIG. 19B is side transverse cross sectional view of the fluid dispensing mechanism in an actuated position for dispensing fluid.
Figure 20:
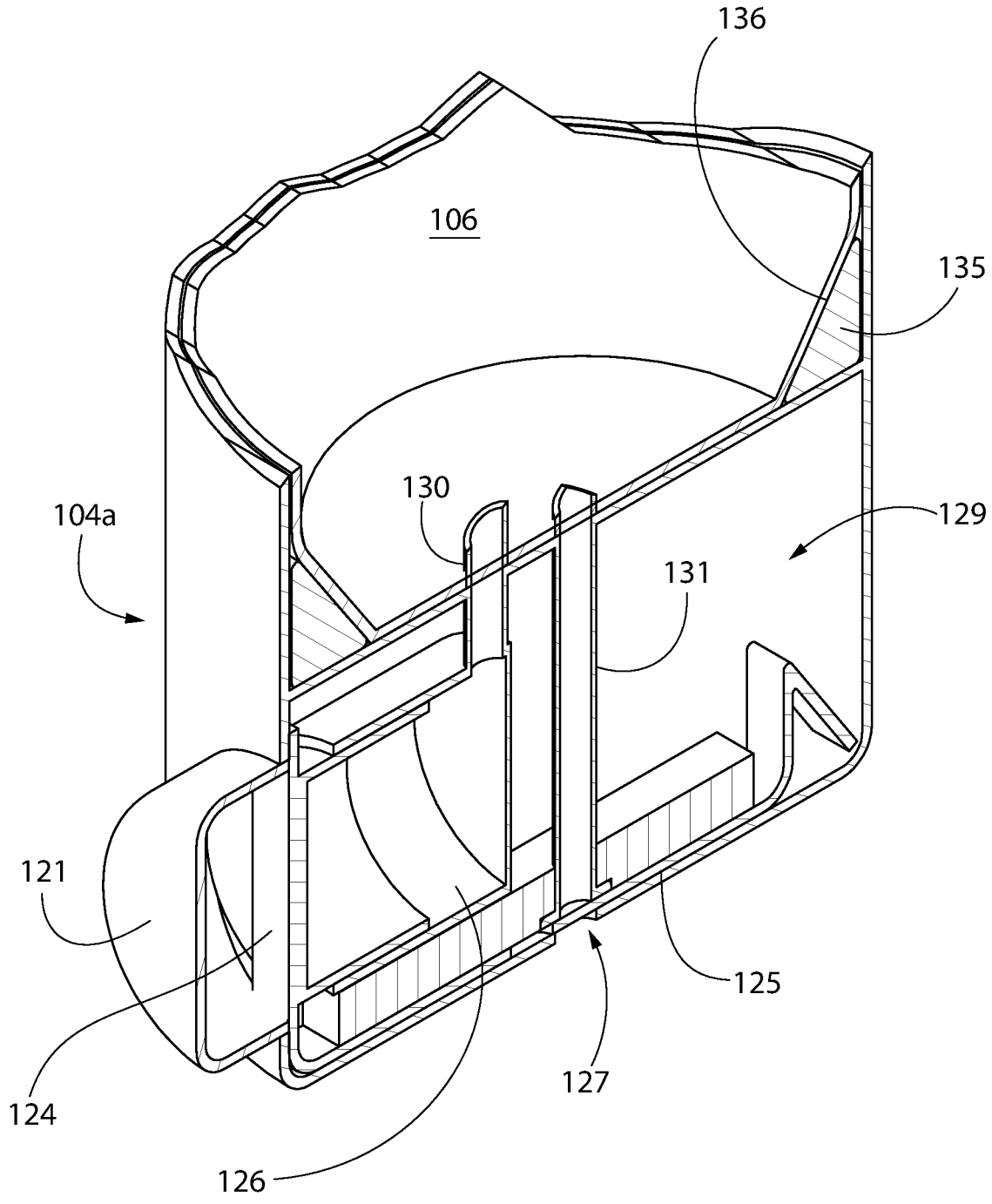
FIG. 20 is a top perspective view of the pressurized air fluid dispensing mechanism.

In the present fluid dispensing mechanism 220, air tube 230 may have an L-shaped body and is not coupled directly to the actuator button assembly unlike in the previous fluid dispensing mechanism 120 and actuator button 121 (see, e.g., FIG. 19A). Referring now initially to FIGS. 27, 31-33, and 45A-B, the present air tube 230 comprises a horizontal section 230*a* and vertical section 230*b* joined at 90 degrees by an elbow section 230*c* of the tube body. Vertical section 230*b* projects upwards beyond partition wall 132 into upper cavity 103*b* of upper canister section 104*b*. When personal care fluid container 106 is mounted inside the upper canister section 104*b*, the pointed top end of the air tube punctures and penetrates the frangible foil seal 106*b* on the mouth of the container along with the pointed top end of present dispensing tube 230 (best shown in FIGS. 31 and 36). The vertical section 230*b* of air tube 230 and may have a height which extends for a majority of the height of canister 104 (see, e.g., FIG. 36). Air tube 230 may further has a greater vertical height than fluid dispensing tube 231; the latter which in the non-limiting illustrated embodiment has a top end that terminates proximate to partition wall 132 and just tall enough to puncture the frangible foil seal 106*b* on fluid container 106.

The horizontal section 230*a* of air tube 230 in the present embodiment is disposed inside air cavity 251 of pump housing 120. Horizontal section 230*a* of present air tube 230 comprises a plurality of air apertures 270 which are each configured to receive air from air chamber 251 when the actuator button 221 is actuated to pump air into the personal care fluid container 106. In one embodiment, apertures 270 may be in the form of elongated air slots 270*a* as shown; however, other non-polygonal shaped (e.g., circular) and polygonal shaped apertures may be used. In the non-limiting illustrated embodiment, two pairs of slots 270*a* are formed in the opposite sides of the air tube 230. A first proximal pair of air slots 270*a* may be formed through the air tube horizontal section 230*a* at a location proximate to vertical centerline Vc of canister 104 and air tube vertical section 230*a*. A second distal pair of air slots 270*a* may be formed at a location distal to the vertical centerline section Vc and vertical section 230*b*, and closest to the sidewall of the air chamber 251 formed by canister 104 (see, e.g., FIGS. 27 and 31).

The first and second pairs of air slots 270*a* are fluidly isolated inside horizontal section 230*a* of air tube 230 by a vertical division wall 230*c*. In one embodiment, the distal air slots 270*a* may be covered with openable/closeable flexible flaps 271. The flaps 271 may be formed of aluminum tape in one implementation; however, other suitable flexible materials may be used. One edge portion of the flaps 271 (e.g., top or bottom edge portion) may be fixedly attached to the air tube adjacent to the air slots 270*a* via any suitable method such as adhesive bonding, while the opposite edge portion remains unattached to the air tube to create pivot-like action of the flap. The outermost end of the horizontal section 230*a* of the air tube may engage and fluidly seal to the arcuately curved sidewall of air chamber 251 formed by inside surface of canister lower section 104*a* within the air chamber (see, e.g., FIGS. 27 and 31). A very small diameter air inlet orifice 290 is disposed within the air tube horizontal section 230*b* and formed through the side of the canister lower section 104*a* as shown which is in fluid communication with ambient atmosphere. The end portion of the horizontal section of the air tube 230 controlled by the flexible flaps 271 is therefore in fluid communication through the air inlet orifice 290.

In operation, pressurized air created in air chamber 251 when air pump 222 is actuated (e.g., depressing actuator button 221) flows through proximal air slots 270*a* and into the fluid container 106. The pressurized air forces the flaps 271 on distal air slots 270*b* against the outside of the air tube horizontal section 230*a* to close off those slots, thereby preventing the pressurized air from entering the distal end portion of horizontal section 230*a* exposed to ambient air pressure through air orifice 290. When the actuator button 221 is released and returns back outwards via the biasing action of return spring 255, the flaps 271 then open to allow ambient air to be drawn back into the pump air chamber 251 through the air inlet orifice 290 and distal air slots 270*b*. By releasing the actuator button 221, the pumping elements 250 are retracted which re-enlarges the volume of the air chamber 251 back to its original size, as further describe herein (see, e.g., FIGS. 43 and 44). This creates a slight negative pressure inside air chamber 251, which acts to draw the higher pressure ambient air back outside canister 104 into the chamber to equalize the pressure. Flaps 271 will reclose once the pressure is equilibrated.

Figure 48:
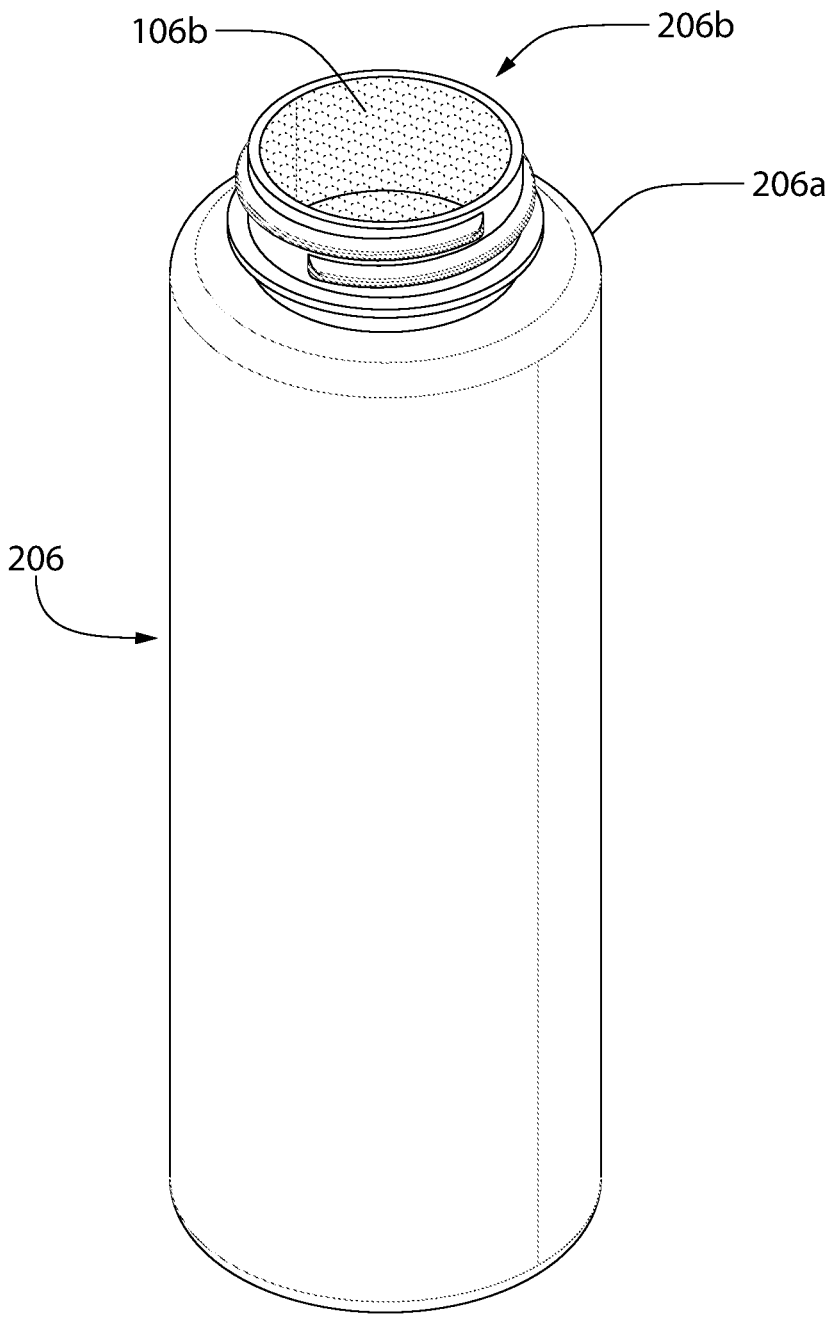
FIG. 48 is a perspective view of a personal care fluid container usable in the fluid dispensing canister of FIG. 25.

FIG. 48 depicts a second embodiment of a personal care fluid container 206 which is usable with the canister 104 having the second embodiment of the fluid dispensing mechanism 220 in FIGS. 26-47. As shown in FIG. 31, the bottom of cavity 103*b* in the upper canister section 104*b* defines an annular step-shaped seating portion 235 which receives and engages complementary configured set-shaped shoulder 206*a* of fluid container 206. This differs in configuration from the frustoconical shaped plastic centering ring 135 in the first embodiment of canister 104 previously described herein in which personal care fluid containers 106 had a complementary configured frustoconical shoulder. The mouth 206*b* of present fluid container 206 is also cover with a frangible seal 106*b* punctured by air and fluid dispensing tubes 230, 231 which the container engages the seating portion 235. It bears noting that in some embodiments, the seating portion 235 of upper canister section 104*b* may instead be frustoconical shaped if fluid containers 106 complementary configured shoulder are to be used with the present fluid dispensing mechanism 220 being described.

Figure 29:
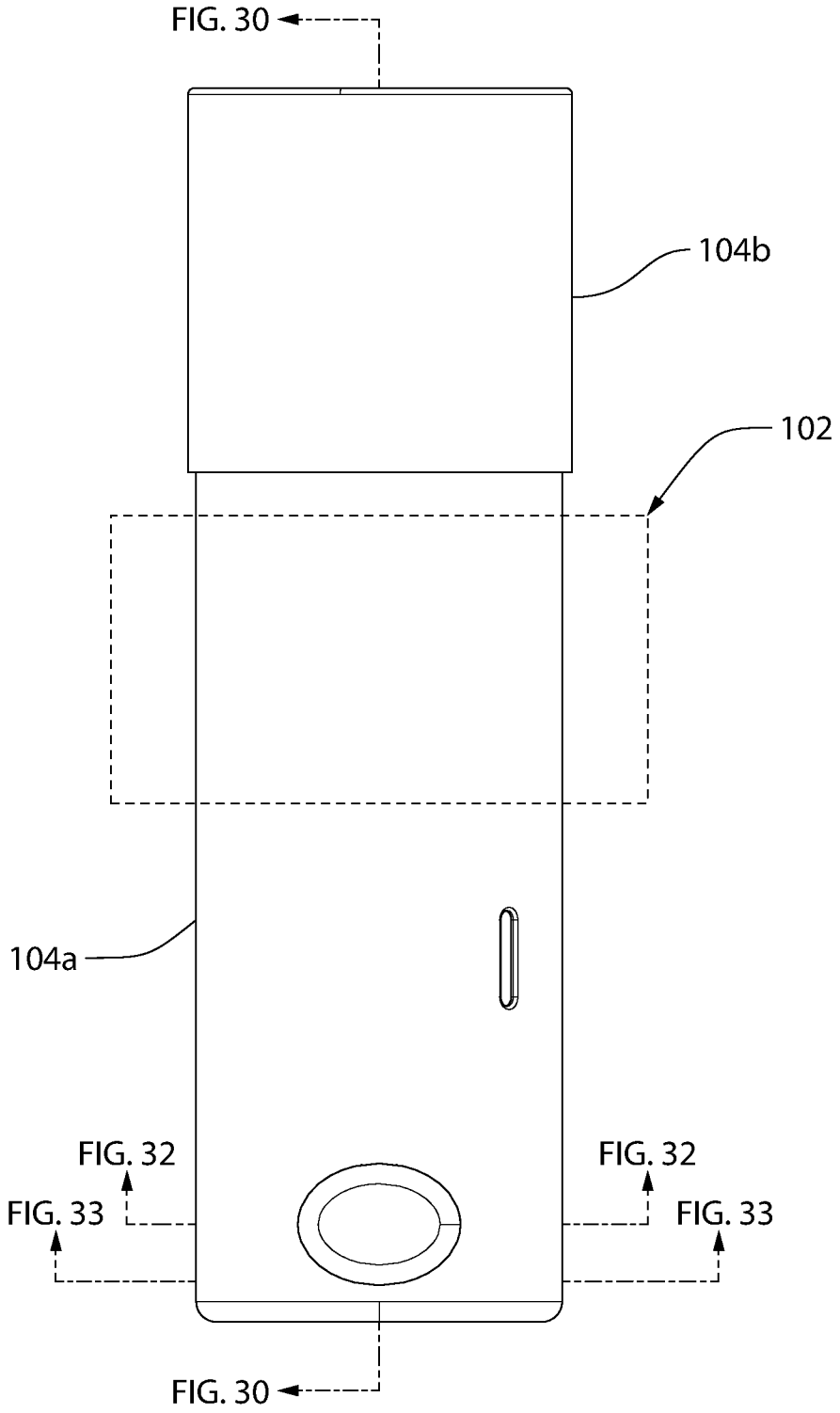
FIG. 29 is a front view of the canister.
Figure 30:
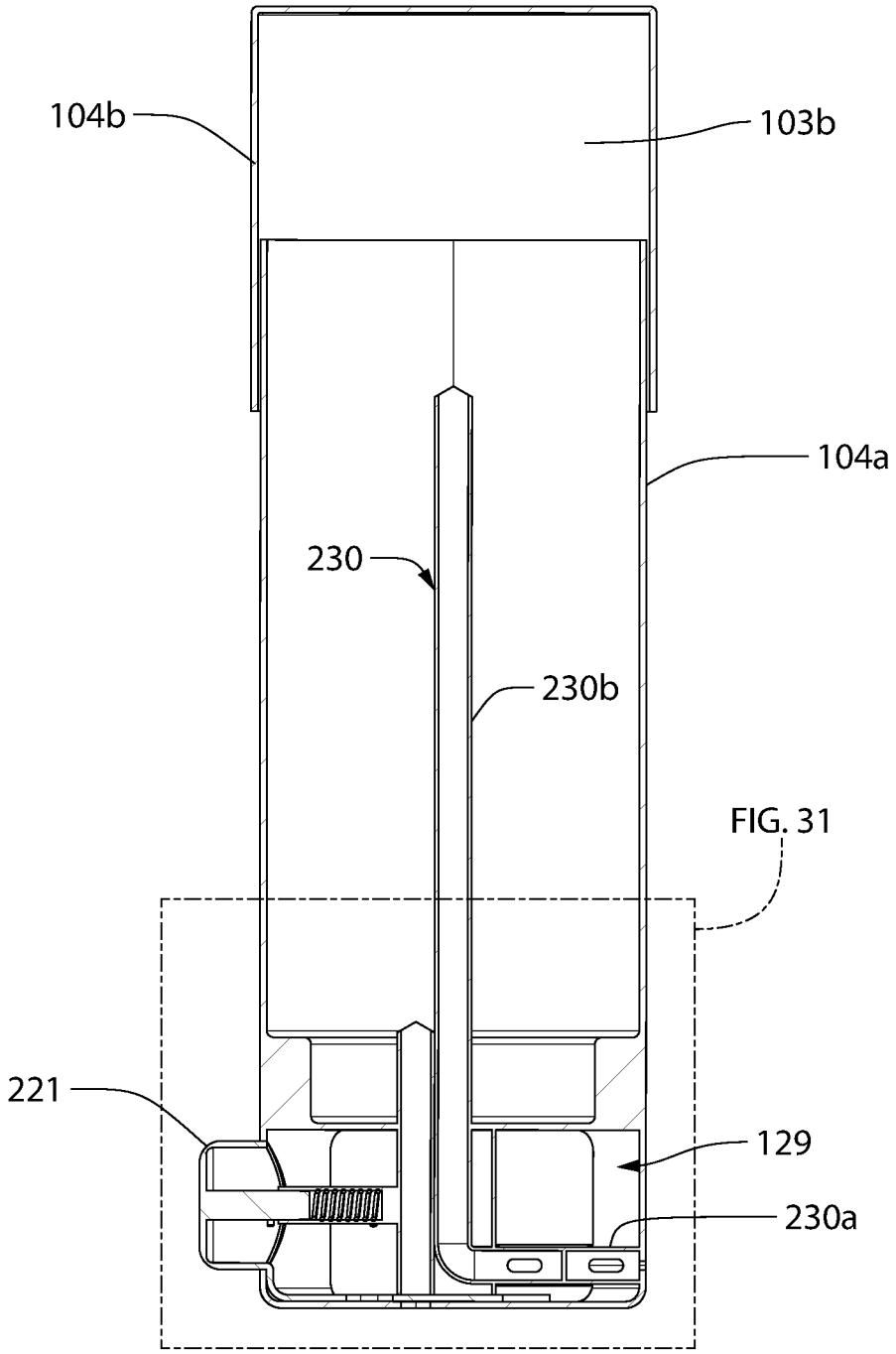
FIG. 30 is a side cross sectional view of the canister.

The canister 104 with present fluid dispensing mechanism 220 is useable with shelf unit 102 (represented schematically in FIG. 29 with dashed lines). In the present embodiment, the canister 104 may be inserted through the upper and lower openings in the shelf unit. The canister lower section 104*a* may be fixedly coupled to the shelf unit by any suitable method such as those previously described herein. The upper end portion of lower canister section 104*a* may extend for a distance above the top surface of the shelf unit as shown. In this embodiment, the upper section 104*b* (which forms a cap structure) of canister 104 is removably attached to the upper end portion of lower canister section 104*a* above the shelf.

Figure 26:
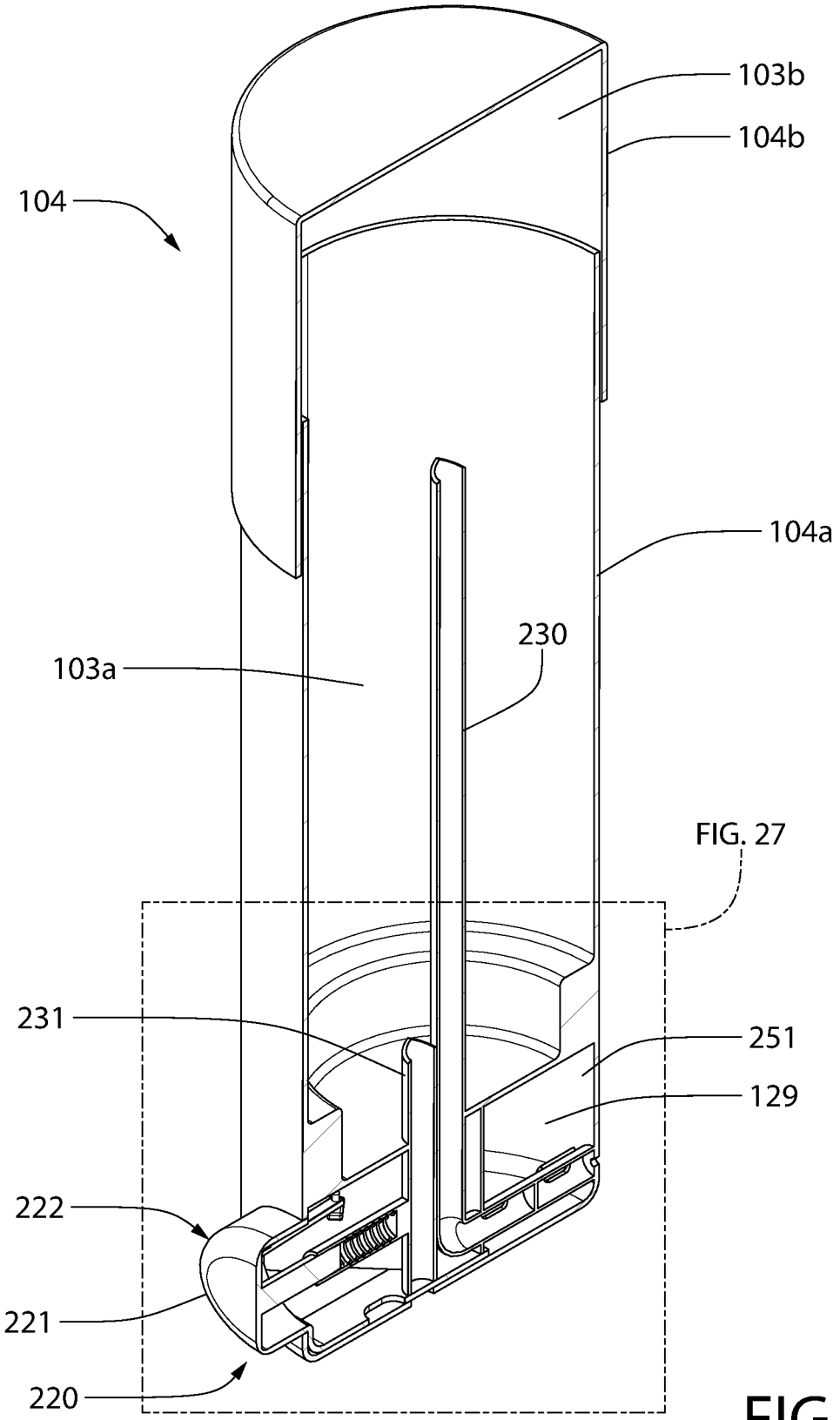
FIG. 26 is a transverse cross sectional view thereof.

Upper section 104*b* may slideably receive the top end of lower canister section 104*a* at least partially therein as the coupling mechanism in one embodiment (see, e.g., FIG. 26). A tight circumferential conformal fit between the two may provide the pressure retention boundary to pressurize the reservoir and its fluid contents. However, other suitable methods for removably coupling the upper section to the lower section of the canister may also be used.

A method for operating fluid dispensing mechanism 220 will now be briefly summarized. Personal care fluid container 206 is first inverted (i.e. foil covered mouth end down) and slideably inserted into canister 104. The container 206 enters upper cavity 103*b* of the canister through the top. The air and fluid dispensing tubes 230, 231 puncture the frangible foil seal 106*b* as the container becomes fully seated in the canister. These aspects are no different than fluid dispensing system 120 previously described herein.

Figure 41:
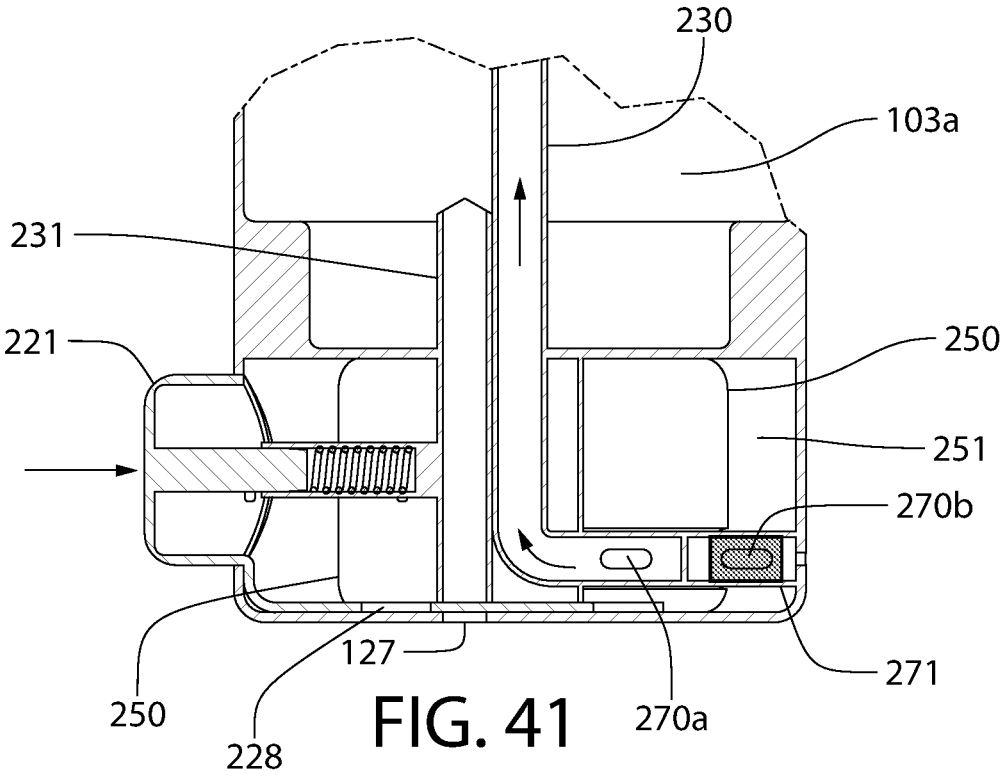
FIG. 41 is a first enlarged side cross-sectional of the pump housing of the canister the manual actuator button of the air pump and wedge-shaped pump elements in a first unactuated position.
Figure 42:
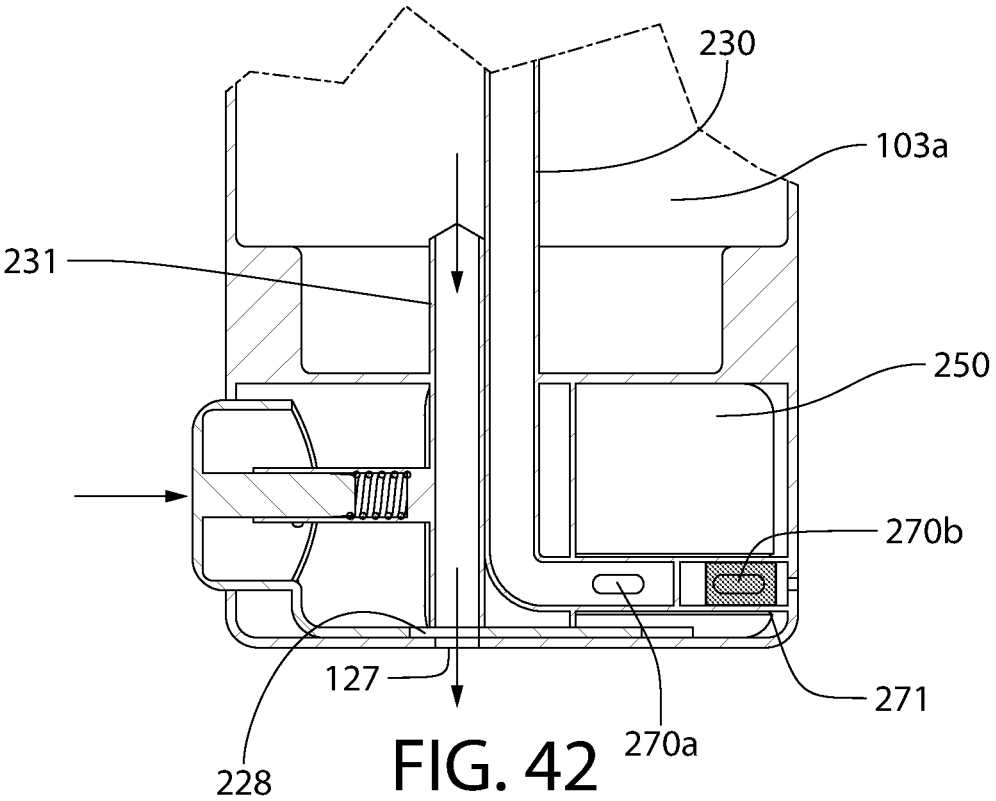
FIG. 42 is a second enlarged side cross-sectional of the fluid dispensing mechanism showing the manual actuator button of the air pump and wedge-shaped pump elements in a second actuated position to pump air into the canister.
Figure 43:
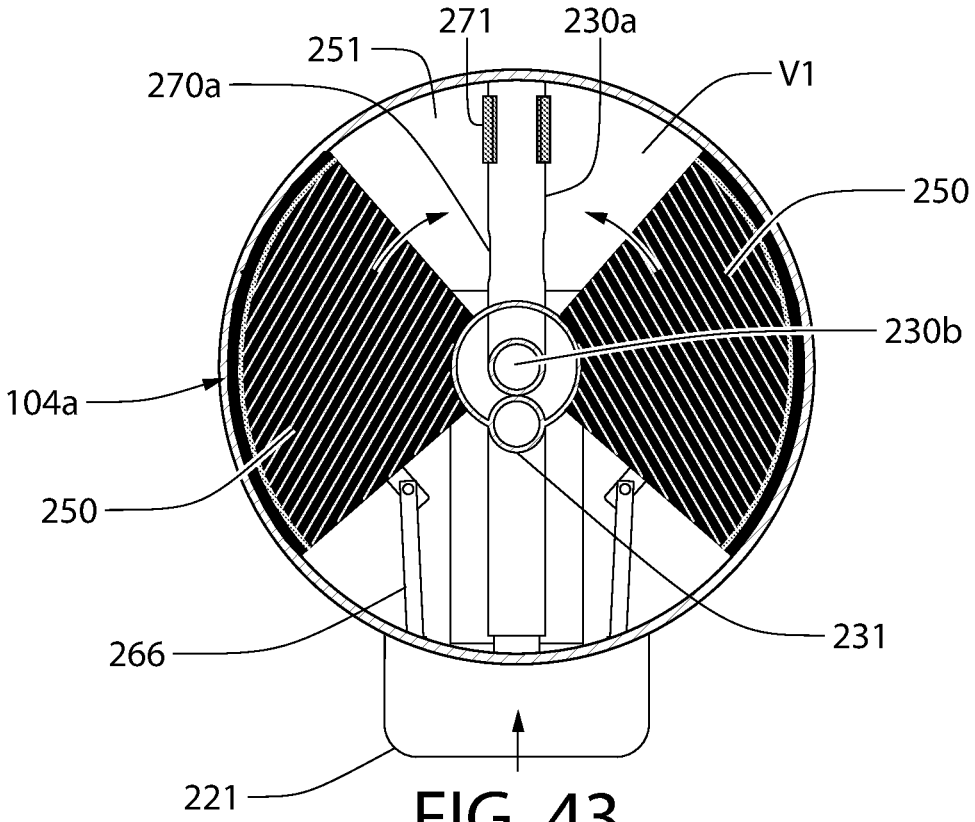
FIG. 43 is a transverse cross sectional view through the air pump mechanism in the pump housing portion of the canister showing the wedge-shaped pumping elements of the air pump in a first unactuated position.
Figure 44:
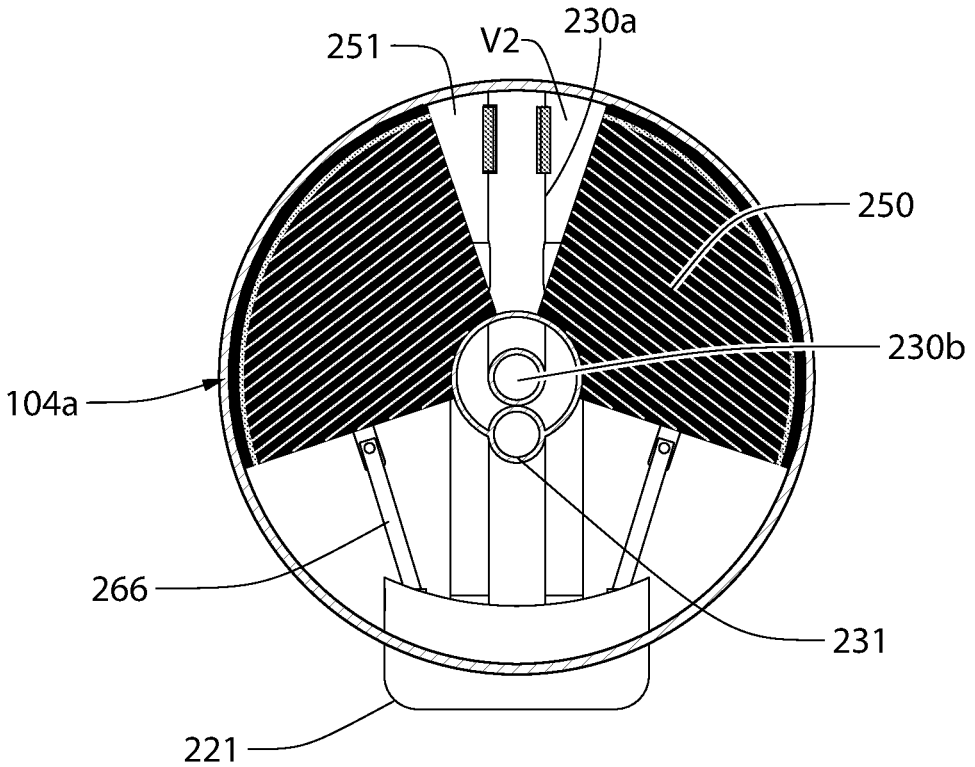
FIG. 44 is a transverse cross sectional view thereof showing the wedge-shaped pumping elements rotated to a second actuated position.
Figure 45A:
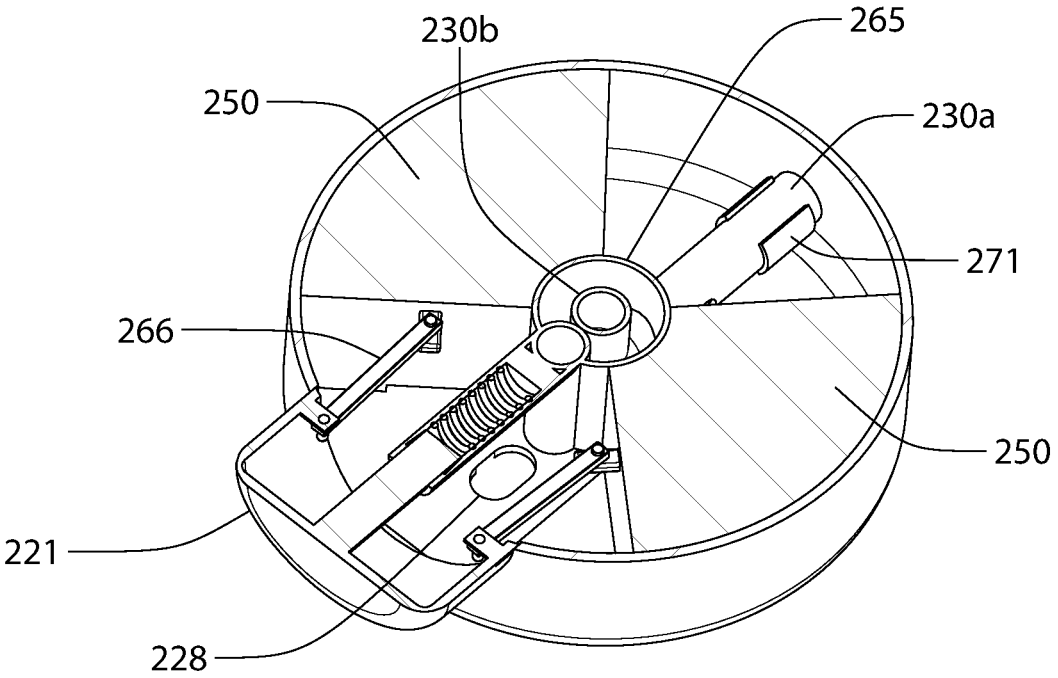
FIG. 45A is an enlarged cross-sectional perspective view taken through the pump housing of the canister showing the air pump components.
Figure 45B:
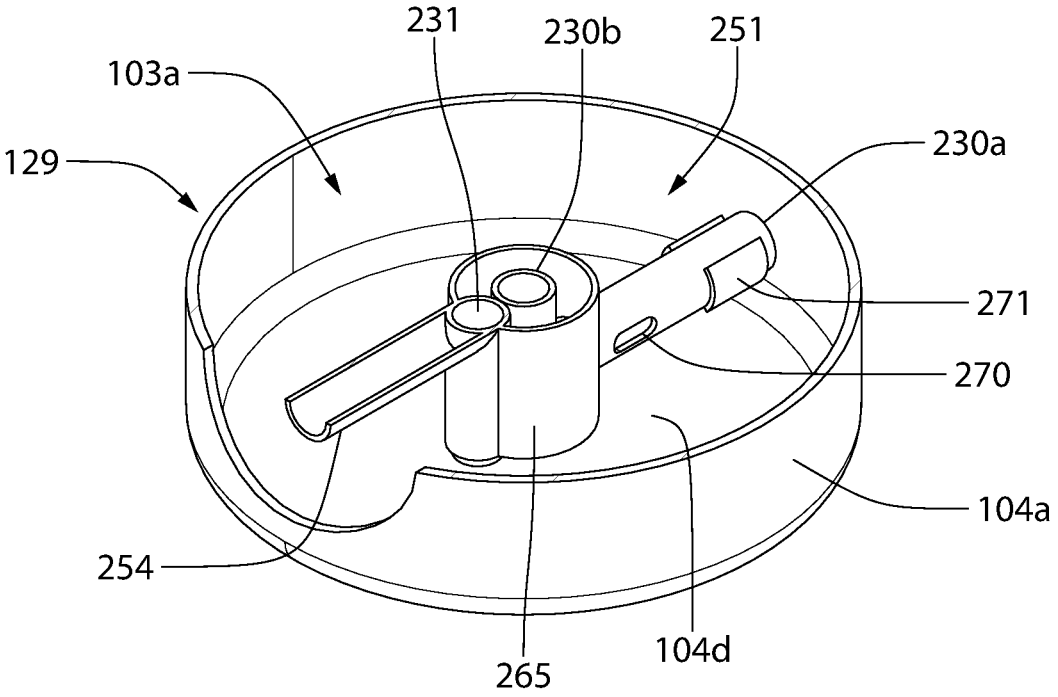
FIG. 45B is an enlarged cross-sectional perspective view taken through the pump housing without the air pump components installed.

Actuator button 221 starts in an outward unactuated position associated with a starting or initial volume V1 of air in the rear air chamber 251 (see, e.g., FIGS. 41 and 43). V1 represents a maximum volume of air which can fill chamber 251.

To dispense personal care fluid, the user presses actuator button 221 inwards (front to rear) into canister 104 to its actuated position. The wedge-shaped pumping elements 250 are pivotably moved and rotate about central guide tube 265 by the button in opposing rotational directions on each side of the guide tube (see, e.g., FIGS. 42 and 44). The pumping elements collapse and shrink the air chamber 251 in size creating a second smaller volume V2. This compresses the air in the chamber which is forced into air tube 230 through air apertures 270. The air is pumped into fluid container 206 through the air tube (vertical section 230*b*), which pressurizes the personal care fluid. The action of depressing the actuator button 221 aligns flow hole 228 in baseplate 252 of the button with flow hole 228 in the bottom of the canister 104. The fluid is dispensed to the user via gravity with an assist by the pressurized air pumped into the fluid container 106 or 206.

When the user releases the actuator button 221, spring 255 returns the button outwards to its unactuated position (see, e.g., FIGS. 41 and 43). The fluid dispenser is ready for the next pumping and dispensing cycle.

Any suitable materials may be used to construct the parts previously described herein of either embodiment of the fluid dispensing system with fluid dispensing mechanisms 120 or 220. In one non-limiting construction, the actuator button 121/221, lower canister section 104*a*, guide tube 265, linkage arms 266, air and fluid dispensing tubes 130/230 and 131/231 respectively, may be made of a suitable plastic material and formed by any suitable method such as without limitation injection molding, 3D printing, etc.

In some alternative embodiments, the personal care fluid container 106 may be omitted. Instead, the personal care fluid may be poured and filled directly from a bulk container into the canister 104. This is analogous to FIG. 36 which shows canister 104 in a condition without the fluid container inserted. The upper portion of internal cavity 103*a* of the canister forms the fluid reservoir R instead. The air and fluid dispensing tubes are configured and function in the same manner to inject air into canister and dispense fluid; however, the tubes are not needed to puncture a frangible foil seal 106*b* on a fluid container. The fluid dispensing mechanisms 120 or 220 previously described herein may be operated in the same manner described to dispense the personal care fluid to the user by actuating the actuator button 121 or 221, respectively. Accordingly, the fluid dispensing system and mechanisms are expressly not limited to use with replaceable fluid containers alone.

Although a manual air pump is described herein and shown, it is contemplated that in other embodiments a battery-operated air pump could be used which is activated by a motion sensor or manually-depressible electric actuator (e.g., button) incorporated in the fluid dispenser.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A fluid dispenser for personal care fluids comprising:

a support structure attachable to a support surface;

a canister supported by the support structure, the canister defining a vertical centerline, a dispensing hole formed in a bottom wall of the canister, and an internal cavity structured to removably receive a fluid container containing a personal care fluid;

the canister comprising a fluid dispensing mechanism configured to pressurize and dispense the fluid from the fluid container through the dispensing hole;

the fluid dispensing mechanism further comprising an air tube insertable into the fluid container which forms an airflow pathway for pumping air from the air chamber into the fluid container, and a fluid dispensing tube insertable into the fluid container which forms a fluid passageway between the fluid container and the dispensing hole;

wherein an outlet of the fluid dispensing tube is concentrically aligned with the dispensing hole in the bottom wall of the canister.

2. The fluid dispenser according to claim 1, wherein the fluid dispensing mechanism comprises a button actuated air pump operable to pump air into the fluid container which pressurizes the fluid.

3. The fluid dispenser according to claim 2, wherein the air pump is manually operated, the button being horizontally moveable between an inward actuated position and an outward unactuated position, and wherein the button comprises an elongated baseplate which is slideable between the outlet of the fluid dispensing tube and the dispensing hole in the bottom wall of the canister, the baseplate having a flow hole formed through top and bottom surfaces thereof which is alignable with the outlet of the fluid dispensing tube and the dispensing hole when the button is in the inward actuated position.

4. The fluid dispenser according to claim 3, further comprising a return spring operable to bias the button towards the unactuated position.

5. The fluid dispenser according to claim 1, wherein the support structure is a horizontally-elongated shelf unit configured for surface mounting to the support surface.

6. The fluid dispenser according to claim 3, wherein the baseplate of the button has a greater width than height.

7. The fluid dispenser according to claim 3, wherein the outlet of the fluid dispensing tube is disposed proximate to the baseplate of the button and the dispensing hole in the bottom wall of the canister.

8. A fluid dispenser for personal care fluids comprising:

a support structure attachable to a support surface;

a canister supported by the support structure, the canister defining a vertical centerline, a dispensing hole, and an internal cavity configured for inserting a fluid container containing a personal care fluid;

the canister comprising a fluid dispensing mechanism configured to pressurize and dispense the fluid from the fluid container through the dispensing hole;

wherein the fluid dispensing mechanism comprises a button actuated air pump operable to pump air into the fluid container which pressurizes the fluid;

wherein the air pump is manually operated, the button being moveable between an inward actuated position and an outward unactuated position;

wherein the button is coupled to a pair of pivotably movable pumping elements operable to compress a volume of air held in an air chamber of the canister, the volume of air being in fluid communication with the fluid in the fluid container.

9. The fluid dispenser according to claim 8, wherein the air chamber is formed in a lower portion of the canister below a horizontal partition wall which defines a pump housing.

10. The fluid dispenser according to claim 9, wherein the fluid dispensing mechanism further comprises an air tube insertable into the fluid container which forms an airflow pathway for pumping air from the air chamber into the fluid container, and a fluid dispensing tube insertable into the fluid container which forms a fluid passageway between the fluid container and the dispensing hole.

11. The fluid dispenser according to claim 10, wherein the button comprises an elongated baseplate including a flow hole, the baseplate being slideably received in the pump housing and movable between a first position in which the flow hole and dispensing hole of the canister are not aligned to prevent fluid from being dispensed when the button is not actuated, and a second position in which the flow hole and dispensing hole are aligned to dispense fluid when the button is actuated.

12. The fluid dispenser according to claim 10, wherein the air tube and fluid dispensing tube each extend vertically through and upwards beyond the partition wall above the air chamber into the fluid container.

13. The fluid dispenser according to claim 12, wherein the air tube is L-shaped comprising a horizontal section disposed in the air chamber and a vertical section which is insertably received inside the fluid container.

14. The fluid dispenser according to claim 13, wherein the horizontal section comprises a plurality of air apertures configured to receive and pass air from the air chamber into the air tube when the air pump is actuated.

15. The fluid dispenser according to claim 14, wherein the air apertures comprises a first pair of elongated air slots and a second pair of elongated air slots.

16. The fluid dispenser according to claim 15, wherein the second pair of elongated slots each include an openable and closeable flap.

17. The fluid dispenser according to claim 8, wherein the pumping elements are wedge-shaped and rotatable about the vertical centerline of the canister in opposing rotational directions when the button is moves between the actuated and unactuated positions.

18. The fluid dispenser according to claim 17, further comprising a guide tube concentrically aligned with the vertical centerline and disposed in the air cavity, pumping element having an arcuately curved inner surface which slideably engages the guide tube when the pumping elements rotate.

19. The fluid dispenser according to claim 18, further comprising a first linkage arm which pivotably couples the button to a first one of the pumping elements, and a second linkage arm which pivotably couples the button to a second one of the pumping elements.

20. A method for dispensing a personal care fluid comprising:

providing a surface-mountable fluid dispenser housing a reservoir holding the fluid;

manually actuating an air pump;

pumping air into the reservoir; and dispensing fluid from the reservoir which is displaced by the air pumped into the reservoir;

wherein the manually actuating step comprises pushing a spring-biased actuator button of an air pump fluidly coupled to the reservoir;

wherein pushing the actuator button rotates a pair of wedge-shaped pumping elements movably disposed in an air chamber of the fluid dispenser housing about a centerline in opposing directions which pressurizes the air in the air chamber.

21. The method according to claim 20, wherein the pressurized air is pumped into the reservoir from the air chamber through an air tube received inside the reservoir.

22. The method according to claim 21, wherein the air enters the air tube through a plurality of air apertures formed in a horizontal section of the air tube in the reservoir, and the pressurized air is discharged into the reservoir through a vertical section of the air tube.

23. The method according to claim 20, wherein the button comprises an elongated baseplate movable with button and including a flow hole, the baseplate being movable between a first position in which the flow hole and a dispensing hole of the fluid dispenser are not aligned to prevent fluid from being dispensed when the button is not actuated, and a second position in which the flow hole and dispensing hole are aligned to dispense fluid when the button is actuated.

24. The method according to claim 20, wherein the reservoir is defined by a fluid container removable disposed inside the fluid dispenser housing.

* * * * *